US012515116B2

(12) United States Patent
Edmonson

(10) Patent No.: US 12,515,116 B2
(45) Date of Patent: Jan. 6, 2026

(54) SYSTEM AND METHOD FOR MEASURING AND DEPICTING A GOLF SWING, MEASURING GOLF BALL LAUNCH PARAMETERS, AND DISPLAYING A RESULTING PREDICTED GOLF BALL FLIGHT PATH

(71) Applicant: SkyHawke Technologies, LLC, Ridgeland, MS (US)

(72) Inventor: Richard C. Edmonson, Ridgeland, MS (US)

(73) Assignee: SkyHawke Technologies, LLC, Ridgeland, MS (US)

( * ) Notice: Subject to any disclaimer, the term of this patent is extended or adjusted under 35 U.S.C. 154(b) by 0 days.

(21) Appl. No.: 18/545,436

(22) Filed: Dec. 19, 2023

(65) Prior Publication Data

US 2025/0195977 A1 Jun. 19, 2025

(51) Int. Cl.
*A63B 69/36* (2006.01)
*A63B 24/00* (2006.01)

(52) U.S. Cl.
CPC ..... *A63B 69/3632* (2013.01); *A63B 24/0003* (2013.01); *A63B 2024/0028* (2013.01)

(58) Field of Classification Search
CPC ..... A63B 69/3632; A63B 24/0003; A63B 2024/0028
See application file for complete search history.

(56) References Cited

U.S. PATENT DOCUMENTS

| | | | | |
|---|---|---|---|---|
| 7,744,480 | B2 | 6/2010 | Gobush | |
| 8,328,653 | B2 | 12/2012 | Lock | |
| 8,409,024 | B2 | 4/2013 | Marty et al. | |
| 8,882,606 | B2 | 11/2014 | Leech et al. | |
| 8,982,216 | B2 | 3/2015 | Ishii et al. | |
| 9,211,439 | B1 | 12/2015 | Pedenko et al. | |
| 9,395,385 | B2 * | 7/2016 | Parke | G01C 25/005 |
| 9,604,118 | B2 | 3/2017 | Davenport et al. | |
| 10,001,563 | B2 * | 6/2018 | Schauermann | G06Q 10/0639 |
| 10,052,542 | B2 | 8/2018 | Tuxen et al. | |
| 10,137,348 | B2 | 11/2018 | Molinari et al. | |
| 10,213,645 | B1 * | 2/2019 | Wu | A63B 24/0003 |
| 10,478,689 | B2 | 11/2019 | Brekke et al. | |
| 10,576,350 | B2 | 3/2020 | Ishikawa et al. | |
| 10,684,677 | B2 | 6/2020 | Kudirka et al. | |
| 10,751,598 | B2 | 8/2020 | Cottam et al. | |
| 10,773,147 | B2 | 9/2020 | Okazaki et al. | |
| 11,077,351 | B2 | 8/2021 | Xu et al. | |
| 11,202,947 | B2 | 12/2021 | Amarant et al. | |
| 2003/0054327 | A1 * | 3/2003 | Evensen | A63B 24/0021 434/252 |
| 2005/0197198 | A1 | 9/2005 | Otten et al. | |
| 2008/0020867 | A1 | 1/2008 | Manwaring | |

(Continued)

*Primary Examiner* — Michael D Dennis
(74) *Attorney, Agent, or Firm* — NEO IP

(57) ABSTRACT

A system integrates a launch monitor sub-system with a tag sub-system including a tag attached to a club. The tag sub-system determines swing parameters for a golf club swing, while the launch monitor sub-system determines launch parameters of the ball to estimate a trajectory of the ball. The system integrates data from both sources, associating swing with resulting ball path via timestamps and is able to simultaneously visualize both the swing and the resulting ball trajectory on the same display device.

20 Claims, 12 Drawing Sheets

(56) References Cited

U.S. PATENT DOCUMENTS

| | | | | |
|---|---|---|---|---|
| 2020/0139214 | A1* | 5/2020 | Saegusa | A63B 69/36 |
| 2020/0147470 | A1 | 5/2020 | Deleon et al. | |
| 2020/0276488 | A1* | 9/2020 | Cottam | G16H 40/63 |
| 2020/0398138 | A1 | 12/2020 | Hendrix et al. | |
| 2021/0069548 | A1* | 3/2021 | Beach | A63B 60/46 |
| 2021/0089761 | A1 | 3/2021 | Tyomkin | |
| 2021/0213327 | A1 | 7/2021 | Ohta et al. | |
| 2021/0220718 | A1 | 7/2021 | Tuxen et al. | |
| 2023/0173341 | A1* | 6/2023 | Root | G16H 30/40 473/409 |
| 2023/0364468 | A1* | 11/2023 | Okur | A63B 24/0021 |
| 2024/0066376 | A1* | 2/2024 | Fitzpatrick | A63B 71/0622 |

* cited by examiner

SYSTEM AND METHOD FOR MEASURING AND DEPICTING A GOLF SWING, MEASURING GOLF BALL LAUNCH PARAMETERS, AND DISPLAYING A RESULTING PREDICTED GOLF BALL FLIGHT PATH

BACKGROUND OF THE INVENTION

1. Field of the Invention

The present invention relates to an improved system and method for golf club and golf ball launch monitoring devices, and more specifically to monitoring devices integrating two types of devices, providing golfers with golf club swing information and information relating to a predicted golf ball flight path resulting from the golf club swing and using data from both devices to show, on a single display, the resulting predicted golf ball flight path as well as a representation of the swing that produced the predicted flight path.

2. Description of the Prior Art

It is generally known in the prior art to provide launch monitoring devices to detect the path of a golf ball after being struck by a club.

Prior art patent documents include the following:

U.S. Patent Pub. No. 2020/0398138 for Hybrid golf launch monitor by inventors Hendrix et al., filed Jun. 2, 2020 and published Jun. 7, 2022, discloses a golf launch monitor configured to determine a flight characteristic of a golf ball. The golf launch monitor includes two low-speed cameras, a trigger device, and a processor. The trigger device is configured to detect a golf swing. The processor is configured to instruct, upon the trigger device detecting said golf swing, the first camera to capture the first ball image; instruct the second camera to capture the second ball image after a time interval, wherein the time interval is less than the first frame rate and the second frame rate; and determine, based at least in part on the first ball image and the second ball image, the flight characteristic of the golf ball.

U.S. Patent Pub. No. 2020/0147470 for Launch monitor by inventors DeLeon et al., filed Nov. 8, 2019 and published Apr. 26, 2022, discloses a launch monitor for golf training including both a continuous wave radar transmitter and a frequency modulated continuous wave radar transmitter. A first set of golf ball trajectory parameters are estimated with the continuous wave radar transmitter and a second, different set of golf ball trajectory parameters are estimated with the frequency modulated continuous wave radar transmitter. The array of transmitters and receivers may be non-uniform.

U.S. Pat. No. 9,604,118 for Golf club distributed impact sensor system for detecting impact of a golf ball with a club face by inventor Davenport, filed Sep. 5, 2014 and issued Mar. 28, 2017, discloses a golf club head including a face with an embedded monolith having first and second sensors for measuring impact with a golf ball. The first and second sensors may output positive and negative pressure signals at the same time, caused by the impact, with the negative pressure indicating an outward bowing of the monolith whereas the positive pressure indicates an inward compression. These positive and negative values may be captured over the duration of impact and used to create a time-varying impact pressure profile with increased accuracy. The club head may also include a mechanism for placing a static pressure on the monolith, increasing negative pressure sensitivity and adjusting the ability to measure negative impact pressures away from the contact point on the club face.

U.S. Pat. No. 8,409,024 for Trajectory detection and feedback system for golf by inventors Marty et al., filed Jan. 16, 2008 and issued Apr. 2, 2013, discloses a system that captures, analyzes and provides feedback related to golf. The system is designed to capture and analyze an initial trajectory of a golf ball and predict a subsequent flight of the ball. The system may be configured to provide immediate feedback that may be utilized by a player to improve their performance as well as provide entertainment value above and beyond what is normally associated with the play of a game of golf. The analysis and feedback system may be portable and may be operable for use in an area where golf is normally played, such as a golf course or an area where golf training takes place, such as a driving range. In one example, the analysis and feedback system may be integrated into a golf bag. Further, the system may be designed to be non-intrusive such that a player may use the system and receive feedback during normal activities associated with golf, such as out on a golf course.

U.S. Pat. No. 10,052,542 for Systems and methods for coordinating radar data and image data to track a flight of a projectile by inventors Tuxen et al., filed Feb. 22, 2016 and issued Aug. 21, 2018, discloses a system for coordinating radar data and image data to track a flight of a projectile including a radar, an imager, and a controller. The imager provides an image of an area into which a projectile is to be launched. The controller receives the image and an identification of a target within the image and identifies a target line connecting the target and a launch position of the projectile. The controller also receives data from the radar relative to at least a portion of a trajectory of the projectile, generates image based trajectory data by correlating the radar data and the image, and alters the image to include the image based trajectory data within the image and the target line within the image.

U.S. Pat. No. 10,751,598 for Systems, methods, and articles of manufacture to measure, analyze and share golf swing and ball motion characteristics by inventors Tuxen et al., filed Feb. 22, 2016 and issued Aug. 21, 2018, discloses systems, methods, computer-readable media and article of manufacture related to measuring, analyzing, and sharing golf swing and ball motion characteristics.

U.S. Pat. No. 11,202,947 for Golf club configuration detection system by inventors Amarant et al., filed May 1, 2020 and issued Dec. 21, 2021, discloses methods and systems for detecting configuration states of a golf club and adjustment systems of a golf club, such as a shaft connection system. A golf club configuration detection system captures configuration data from the adjustment system of the golf club by a configuration detection device, such as a camera, a barcode scanner, or an RFID scanner. The captured configuration data is compared to reference configuration data to determine a configuration state of the adjustment system. Swing data and ball-flight data are tracked for golf-ball strikes with the golf club in the detected configuration state. Recommendations for configuration states may be generated based on the tracked data.

U.S. Pat. No. 10,137,348 for Method and apparatus for low resolution golf swing image capture analysis by inventors Molinari et al., filed Aug. 30, 2017 and issued Nov. 27, 2018, discloses a method and system for using a low resolution image of a golfer's swing for analysis. Cameras obtain images of various portions of a golfer's swing. A computer calculates parameters associated with a golfer and a golf club from the images. Parameters include body angles, head position, shoulder positions, arm positions, hand positions, leg positions, foot positions, club shaft angles, and club head position. Different portions of the swing are captured using the cameras, including a static initial address, a backswing, a downswing, a forward swing, and a follow-through. A computer uses measured parameters from two or more portions of the swing to determine comparative parameters during different portions of the swing. The computer uses the parameters to generate swing analysis outputs, including swing characteristic information and/or swing profile information. A correlation table relates identified swing analysis outputs to recommendations to the golfer to improve the swing.

U.S. Patent Pub. No. 2021/0089761 for Golf game video analytic system by inventor Tyomkin, filed Nov. 29, 2020 and published Mar. 25, 2021, discloses a system and method for video analytics of a golf game. In an embodiment, cameras capture videos from different angles of a golfer's swing and/or strike; a system network comprises: a processing module to receive the videos, to 3D-model the trajectory of the swing/strike, and 3D-model the golfer; a machine-learning module to receive 3D swing-trajectories and golfer models of swings/strikes of professional golfers and compute a 3D model of one or more reference swings, as a function of an aggregation of the professional golfers' swings/strikes; a database storing the reference swings/strikes; an analysis module configured to receive the golfer's 3D swing/strike trajectory model and the 3D golfer model, compare the 3D trajectory model with the reference swing, and compute recommendations for the golfer, as a function of the comparison; and a display module configured to display the recommendations to the golfer.

U.S. Pat. No. 8,882,606 for Golf swing data gathering method and system by inventors Leech et al., filed Jan. 28, 2010 and issued Nov. 11, 2014, discloses a method and system for capturing, transmitting, and displaying golf swing data using data capture elements in golf balls or golf clubs to capture data and transmission elements to transmit the golf swing data to a mobile computing auxiliary device. The mobile computing auxiliary device relays the captured and transmitted golf swing data to a mobile computing device. The mobile computing device transmits the golf swing data to a database. A server associated with the database generates web pages to make the golf swing data available over the internet.

U.S. Pat. No. 8,328,653 for Object location and movement detection system and method by inventor Lock, filed Sep. 19, 2008 and issued Dec. 11, 2012, discloses a system and method for detecting object location and movement utilizing a first viewing area observed by a first camera cooperating with a light and a second camera cooperating with a light. A third camera can be added to observe a second viewing area encompassing the first viewing area. The first camera acquires images at time spaced points and along a first trajectory line. The second camera acquires images at time spaced points and along a second trajectory line. This information is combined to generate the 3-D trajectory line of the object.

U.S. Pat. No. 8,982,216 for Portable movement capture device and method of finite element analysis by inventors Ishii et al., filed Nov. 4, 2011 and issued Mar. 17, 2015, discloses a portable movement capture device. The portable movement capture device includes one or more cameras that capture high-speed video or still images of a player performing a sports activity. In one embodiment, the sports activity is a golf swing of a golfer. The portable movement capture device is arranged in a housing with one or more cameras and may optionally include a number of additional components to assist with capturing information associated with a player performing a sports activity. The captured information is analyzed using a method of finite element analysis to isolate a portion of the captured information. With this arrangement, specific regions of a player are analyzed, individually, or relatively with other regions, for a particular movement associated with the sports activity. A handheld motion capture device is also described that combines components of a portable movement capture device with an integrated display.

U.S. Pat. No. 9,211,439 for Three dimensional golf swing analyzer by inventors Pedenko et al., filed Jan. 17, 2014 and issued Dec. 15, 2015, discloses an apparatus, system and method for golf swing analysis using a first microprocessor, a three-axis accelerometer that transmits linear acceleration data to the first microprocessor, a three-axis gyroscope that transmits angular velocity data to the first microprocessor, data processing, a radio transmitter for transmitting processed data, and a housing for holding the components, which attaches to a golf club. A camera with image recognition software and an ultrasonic and RF navigation system are used for error correction. A camera on the portable device may be used to capture video, which is trimmed to correspond with the animation, and the video may be placed side by side with the animation for visual analysis. Further error correction occurs using image sensors to determine moving object speeds and coordinates.

U.S. Patent Pub. No. 2021/0213327 for Swing Analysis Device, Swing Analysis Method, and Swing Analysis System by inventors Ohta et al., filed Mar. 8, 2018 and published Apr. 5, 2022, discloses a swing analysis device for analyzing a swing of a user of a golf club accepting input of acceleration information, angular rate information, and strain information of a shaft of the golf club, detected by a sensor attached to the shaft, calculating attitude information of the golf club in a swing period, based on the acceleration information and the angular rate information, correcting the attitude information of the golf club at impact, based on the strain information of the shaft, and displaying the corrected attitude information of the golf club on a display.

U.S. Patent Pub. No. 2008/0020867 for Golfer's impact properties during a golf swing by inventor Manwaring, filed Jul. 26, 2007 and published Jan. 24, 2008, discloses a method for determining a golfer's golf club head orientation and impact location for a golf swing. The method inputs the optimized values for the golf club head orientation and impact location, a plurality of golf swing properties of a golfer, a plurality of mass properties of a first golf club, and a plurality of mass properties of a first golf ball into a rigid body code. A plurality of calculated ball launch parameters is generated from the rigid body, which are compared to a plurality of actual ball launch parameters measured using a CMOS imaging system. The ball launch parameters are compared to each other to verify the optimized values. If the verification is not within a predetermined value, new optimized values are selected for the method. The method is repeated until the verification is within the value.

U.S. Pat. No. 11,077,351 for Measurement and reconstruction of the golf launching scene in 3D by inventors Xu et al., filed May 28, 2019 and issued Aug. 3, 2021, discloses a golf launching monitoring arrangement allowing equipment to be placed at a position behind the player (i.e., behind the golf ball), to measure both club and ball movement. A 3D scan of the club head before the play serves two purposes: 1) 3D registration that enables accurate measurement of the club head position and orientation for the camera system measuring the club movement from the back; 2) for reconstruction of the launching scene. With a 3D model of the club head, a simple 3D model of the golf ball and accurate measurement of their movement during the play, a full 3D golf launching scene can be reconstructed authentically. With this reconstruction, the movement of both the club head and the resulting ball movement can be replayed at any viewing angle, with any frame rate and at whatever resolution for the players or the coaches to view and analyze.

U.S. Pat. No. 10,478,689 for Method, system, and apparatus for analyzing a sporting apparatus by inventors Brekke et al., filed Apr. 3, 2017 and issued Nov. 19, 2019, discloses a method for use in a system implementing a reference golf club, one or more sensors associated with the reference golf club, and a computing device. Using the computing device, the method comprises receiving from the one or more sensors swing data relating to a swing of the reference golf club, analyzing the swing data to determine recommended shaft parameter values for each of a plurality of shaft parameters using an algorithm, accessing a shaft database comprising actual shaft parameter values for each of the plurality of shaft parameters for each of a plurality of shafts, determining at least one shaft from the plurality of shafts based, at least in part, on a comparison between the recommended shaft parameter values and the actual shaft parameter values, transmitting information relating to the at least one shaft; and displaying the information on a display of the computing device.

U.S. Pat. No. 10,684,677 for Mixed-reality golf tracking and simulation by inventors Kudirka et al., filed Sep. 9, 2019 and issued Jun. 16, 2020, discloses a mixed-reality golf simulation system including a ball-tracking sub-system to generate ball-tracking data when a golf ball is hit by a user, a near-eye display, a storage device to store images of a hole of a golf course associated with location coordinates of a plurality of locations along the hole, and a controller. The controller may direct the near-eye display to display a mixed-reality environment from the perspective of a location on the hole based on images associated with the location, receive ball-tracking data including a landing location of a ball hit by the user, alert the user if the landing location is a target pin, and direct the near-eye display to display a mixed-reality environment from the perspective of the landing location based on images associated with the landing location if the landing location is not the target pin.

U.S. Pat. No. 7,744,480 for One camera club monitor by inventor Gobush, filed Jan. 20, 2004 and issued Jun. 29, 2010, discloses a single camera monitoring system useful for determining parameters relating to a striking instrument as it approaches an object. The monitoring system may be used to determine the swing characteristics of a golf club as it approaches and impacts with a golf ball. The accuracy of the single camera system may be comparable to the accuracy of more complex, multi-camera systems. The application also relates to methods for calibrating a single camera system.

U.S. Patent Pub. No. 2003/0054327 for Repetitive motion feedback system and method of practicing a repetitive motion by inventor Evensen, filed Sep. 20, 2001 and published Mar. 20, 2003, discloses a repetitive motion feedback system with various sensors and devices for monitoring aspects of a repetitive motion sequence, such as a golf swing. The monitored aspects can include motion properties of an object moved by the user, position properties of the user and motion properties of the user. A data processing system for receiving data of the monitored aspects provides feedback data that is provided to a feedback output device, such as a graphical display device or speaker, so that the user is provided with feedback regarding the repetitive motion sequence. In one particular embodiment, the user's performance is compared to a template of a prior performance, with feedback being provided regarding the differences.

U.S. Pat. No. 10,576,350 for Simulation apparatus, simulation method, and simulation system by inventor Ishikawa, filed Nov. 1, 2017 and issued Mar. 3, 2020, discloses a simulation apparatus including an obtaining unit configured to obtain a measurement result of a test shot of a first golf club performed by a testing golfer, and a calculation unit configured to calculate a simulated ball-striking result which is obtained if the testing golfer strikes a golf ball by a second golf club which has a specification different from the first golf club. The calculation unit determines a swing characteristic of the testing golfer based on the measurement result. The calculation unit calculates the simulated ball-striking result based on the swing characteristic and the measurement result.

U.S. Patent Pub. No. 2021/0220718 for System and Method for Tracking Sports Balls by inventors Tuxen et al., filed Jan. 19, 2021 and published Jul. 22, 2021, discloses a system for determining potential changes in trajectories of golf shots including a sensor array sensing swing data relating to a golfer's swing and trajectory data relating to the trajectories of each of a plurality of shots hit by the golfer and a computing arrangement including a data repository and a processor configured to: store in the data repository the swing data and the trajectory data; identify shots hit by the golfer that represent mishits; and determine output data based on the swing data and the trajectory data for all of the shots hit by the golfer that are not identified as mishits, the output data indicating an optimal shot achievable by the golfer.

U.S. Patent Pub. No. 2021/0069548 for Systems and methods for integrating measurements captured during a golf swing by inventors Beach et al., filed Sep. 3, 2020 and published Mar. 11, 2021, discloses systems and methods for aggregating measurements captured by different technologies during a golf swing. By capturing measurements using different technologies, more accurate measurements may be provided to a user by selecting from the measurements, offsetting measurements based on the technologies used, and aligning measurements between devices. Further, by aggregating measurements received from different devices, additional features and functionality may be provided to the user that is absent from any one device used alone. Additionally, by storing the aggregated measurements, users, club fitters and instructors may access and leverage larger databases of measurements to better understand the user's golf swing and to provide better recommendations and instruction to the user.

U.S. Pat. No. 10,773,147 for Virtual golf simulation apparatus by inventors Okazaki et al., filed Feb. 27, 2019 and issued Sep. 15, 2020, discloses a virtual golf simulation apparatus including a processor. The processor is connected to an output device and is configured to acquire measurement data obtained by using a measurement device to measure an actual shot performed by a golfer, analyze a shot characteristic of the golfer based on the measurement data, virtually generate a virtual golfer having a shot characteristic corresponding to the shot characteristic of the golfer, receive, from the golfer, an instruction instructing the virtual golfer to perform an action in a virtual space, simulate a shot of the virtual golfer in the virtual space in accordance with the instruction, and output a result of the simulation to the output device.

U.S. Patent Pub. No. 2005/0197198 for Method and apparatus for sport swing analysis system by inventors Otten et al., filed Sep. 15, 2004 and published Sep. 8, 2005, discloses a sport swing analysis system creating a three dimensional virtual environment and relating swing parameter measurements to the three dimensional virtual environment.

SUMMARY OF THE INVENTION

The present invention is generally directed to an improved system and method for golf club and golf ball launch monitoring devices, and more specifically to monitoring devices integrating two types of devices, providing golfers with golf club swing information and information relating to a predicted golf ball flight path resulting from the golf club swing and using data from both devices to show, on a single display, the resulting predicted golf ball flight path as well as a representation of the swing that produced the predicted flight path.

It is an object of this invention to provide systems and methods that enable golfers and golf teachers to visualize both the swing path of a golf club that strikes a golf ball and the resulting predicted flight path of the struck ball to enable golfers and golf teachers to identify strengths and weaknesses of a golfer's swing and make improvements to the golfer's swing and, ultimately, the golfer's golfing ability. Another object of the invention is to permit separate manufacturers of the tag device and the launch monitor device to integrate the results of their respective tag and launch monitor outputs in a single product output.

In one embodiment, the present invention is directed to a golf swing and ball path visualization system, including at least one tag device affixed to a golf club operable to generate swing sensor data including position, velocity, and/or acceleration data for the golf club, a launch monitor including a ball capture system operable to generate launch parameter data for a golf ball struck by the golf club, and at least one display device, wherein the at least one tag device is configured to transmit the swing sensor data to a software application associated with the launch monitor, wherein the software application includes a tag device software development kit (SDK), wherein the tag device SDK generates swing parameters based on the swing sensor data, wherein the launch parameter data and the swing parameters are transmitted to and stored in at least one database, and wherein the at least one display device displays a 2-D or 3-D reconstruction of a golf swing and a golf ball trajectory based on matched data points from the launch parameter data and the swing parameters.

In another embodiment, the present invention is directed to a method for visualizing a golf swing and a golf ball trajectory, including at least one tag device affixed to a golf club generating swing sensor data including position, velocity, and/or acceleration data for the golf club, a launch monitor, including a ball capture system, generating launch parameter data for a golf ball struck by the golf club, the at least one tag device transmitting the swing sensor data to a software application associated with the launch monitor, wherein the software application includes a tag device software development kit (SDK), the tag device SDK generating swing parameters based on the swing sensor data, transmitting the launch parameter data and the swing parameters to at least one database, and at least one display device displaying a 2-D or 3-D reconstruction of a golf swing and a golf ball trajectory based on matched data points from the launch parameter data and the swing parameters.

In yet another embodiment, the present invention is directed to a golf swing and ball path visualization system, including at least one tag device affixed to a golf club operable to generate swing sensor data including position, velocity, and/or acceleration data for the golf club, a launch monitor including a ball capture system operable to generate launch parameter data for a golf ball struck by the golf club, and at least one display device, wherein the at least one tag device is configured to transmit the swing sensor data to a software application associated with the launch monitor, wherein the software application includes a tag device software development kit (SDK), wherein the tag device SDK generates swing parameters based on the swing sensor data, wherein the launch parameter data are stored in a launch parameter database, wherein the swing parameters are transmitted via an application programming interface (API) and stored in a tag database, wherein swing parameters corresponding to a golf swing and launch parameter data corresponding to a golf ball strike are matched based on timestamp data, and wherein the at least one display device displays a 2-D or 3-D reconstruction of the golf swing and the golf ball strike.

These and other aspects of the present invention will become apparent to those skilled in the art after a reading of the following description of the preferred embodiment when considered with the drawings, as they support the claimed invention.

DETAILED DESCRIPTION

Figure 1:
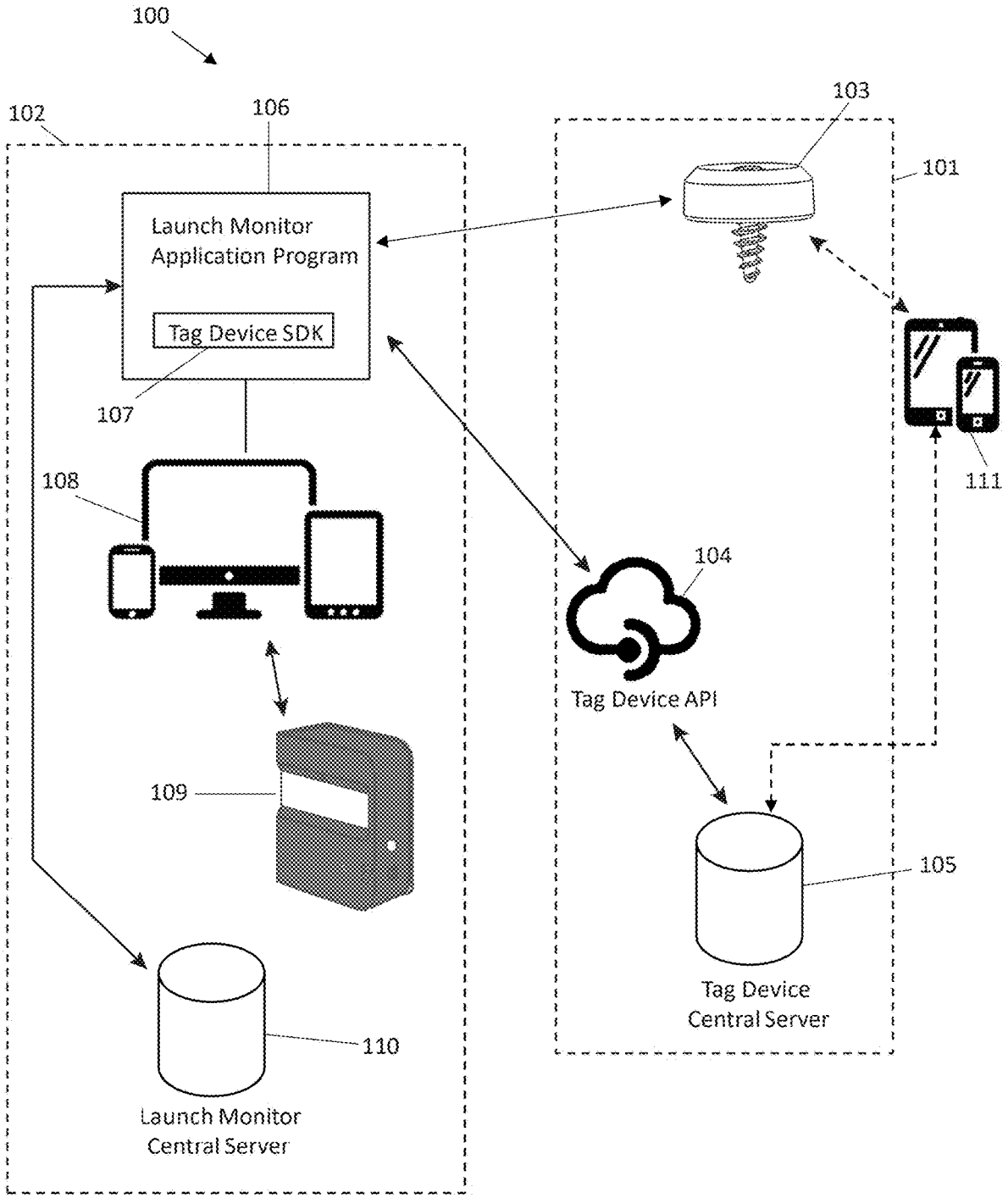
FIG. 1 is a high-level schematic diagram of a system able to access data from a launch monitor as well as a tag device according to one embodiment of the present invention.

The present invention is generally directed to an improved system and method for golf club and golf ball launch monitoring devices, and more specifically to monitoring devices integrating two types of devices, providing golfers with golf club swing information and information relating to a predicted golf ball flight path resulting from the golf club swing and using data from both devices to show, on a single display, the resulting predicted golf ball flight path as well as a representation of the swing that produced the predicted flight path.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or.

In one embodiment, the present invention is directed to a golf swing and ball path visualization system, including at least one tag device affixed to a golf club operable to generate swing sensor data including position, velocity, and/or acceleration data for the golf club, a launch monitor including a ball capture system operable to generate launch parameter data for a golf ball struck by the golf club, and at least one display device, wherein the at least one tag device is configured to transmit the swing sensor data to a software application associated with the launch monitor, wherein the software application includes a tag device software development kit (SDK), wherein the tag device SDK generates swing parameters based on the swing sensor data, wherein the launch parameter data and the swing parameters are transmitted to and stored in at least one database, and wherein the at least one display device displays a 2-D or 3-D reconstruction of a golf swing and a golf ball trajectory based on matched data points from the launch parameter data and the swing parameters.

In another embodiment, the present invention is directed to a method for visualizing a golf swing and a golf ball trajectory, including at least one tag device affixed to a golf club generating swing sensor data including position, velocity, and/or acceleration data for the golf club, a launch monitor, including a ball capture system, generating launch parameter data for a golf ball struck by the golf club, the at least one tag device transmitting the swing sensor data to a software application associated with the launch monitor, wherein the software application includes a tag device software development kit (SDK), the tag device SDK generating swing parameters based on the swing sensor data, transmitting the launch parameter data and the swing parameters to at least one database, and at least one display device displaying a 2-D or 3-D reconstruction of a golf swing and a golf ball trajectory based on matched data points from the launch parameter data and the swing parameters.

In yet another embodiment, the present invention is directed to a golf swing and ball path visualization system, including at least one tag device affixed to a golf club operable to generate swing sensor data including position, velocity, and/or acceleration data for the golf club, a launch monitor including a ball capture system operable to generate launch parameter data for a golf ball struck by the golf club, and at least one display device, wherein the at least one tag device is configured to transmit the swing sensor data to a software application associated with the launch monitor, wherein the software application includes a tag device software development kit (SDK), wherein the tag device SDK generates swing parameters based on the swing sensor data, wherein the launch parameter data are stored in a launch parameter database, wherein the swing parameters are transmitted via an application programming interface (API) and stored in a tag database, wherein swing parameters corresponding to a golf swing and launch parameter data corresponding to a golf ball strike are matched based on timestamp data, and wherein the at least one display device displays a 2-D or 3-D reconstruction of the golf swing and the golf ball strike.

Golf is a club-and-ball sport in which players use a variety of golf clubs to strike golf balls across a golf course in an attempt to reach a series of holes on the course in as few strokes as possible. Golf is an incredibly popular game that has developed an increasingly competitive community. Golf communities and golf players pride themselves on reducing their strokes per hole, which is the center focus of the game.

There is a wide market for devices, techniques, systems, and classes to increase one's golfing skills and reduce one's strokes per game. To become a more proficient golfer, golfers must understand the intricacies of their golf stroke. To better understand one's golf stroke, computer devices have been implemented that assist golfer training. These devices include golf launch monitors and golf club tags. For example, golf club tag devices that measure the angle, speed, acceleration, contact point, and orientation of one's golf swing are often used to analyze a golfer's swing performance, which is used to better one's golf play. Other examples include golf launch monitors that permit golfers to hit a golf ball, often indoors into a net, and from measurements taken by the device of the ball launch parameters, predict a ball flight, which is used for training as well as playing simulated golf games.

Golf launch monitors capture the launch parameters of a struck golf ball, then communicate the launch parameter data to a processor that applies a ballistic flight model software program to the data in order to determine and display a predicted flight path of the struck golf ball. The launch parameters of a golf ball necessary to derive an accurate flight path include ball speed, launch angle, backspin, and side spin. See, Jorgensen, Theodore, The Physics of Golf (Second Edition, 1999). Golf launch monitors are most typically radar-based, such as the MEVO+ by FLIGHTSCOPE, photometric-based, such as the SKYTRAK launch monitor by GOLFTEC, or a combination of radar and photometric, such as the SKYTRAK+ by GOLFTEC and the TRACKMAN 4 by TRACKMAN.

Prior art golf launch monitors, however, are capable of providing very little data about the performance of the golf club that strikes the golf ball. Golf launch monitors are primarily focused on the performance of the golf ball. While some high-end launch monitors are able to measure some of the golf club activity, such as, for example, clubhead speed and attack angle, much of the golf club information produced by prior art golf launch monitor devices is calculated based on ball data and physic formulas, and overall club swing data is very limited. The result is inaccurate and incomplete club swing data.

Sensor devices placed on a golf club, often called "club tags" or simply "tags," such as the SKYPRO device or the ARCCOS device, use micro sensors, such as accelerometers and gyros, to measure the golf club swing activity during a golf swing. Some club tags, like the ARCCOS device, provide very limited swing data and are used primarily to determine when a golf stroke is made and, if used in conjunction with a GPS device, the location at which the stroke took place. Other club tags, like the SKYPRO club tag, are full swing analysis devices and include much more information about the golf club during a swing and are able to re-create the entire swing from address, through the backswing, to impact, and through the follow-through, and, when connected with a processor, re-create a digital image of the swing. Prior art devices, like the SKYPRO, provide accurate information about the golf club during the swing, but they cannot measure any ball data that results from the striking of the golf ball by the depicted swing.

Thus, while higher end golf launch monitors with the capability to measure all four parameters of a golf ball's launch—ball speed, launch angle, backspin, and side spin—are able to accurately predict a ball flight path when used in conjunction with a processor implementing a flight model, they provide little or no measured, accurate information about the golf club swing used to strike the golf ball. On the other hand, while golf club tags, such as the SKYPRO, accurately measure and re-create a golf club swing used to strike a golf ball, they provide no ball launch parameter data needed to predict the ball flight path.

Therefore, what is needed is a single system that is able to both accurately measure and re-create a golf club swing and determine a predicted golf ball flight path created by that measured club swing.

The present invention solves this problem of prior art devices by providing a system that integrates launch monitor and tag output data to accurately measure the golf club during a swing, re-create a digital image of the swing, measure the golf ball launch parameters generated by that golf swing, determine the golf ball flight path resulting from the striking of the golf ball with the measured swing and display, on a single display, both the digital image of the swing and the predicted ball flight path resulting from the swing.

In one embodiment the present invention includes a tag device attachable to a golf club for analyzing golf swings and displaying a 2-D or 3-D representation of the swing through a device with a plurality of sensors, a golf launch monitor for analyzing the launch parameters of a golf ball struck with a swing that is analyzed by the tag device and displaying a predicted flight path of the struck golf ball, and interfaces and communications that link the outputs of the tag device subsystem and launch monitor subsystem to show, on the display of a connected computer, both the representation of the golf swing and the predicted flight path produced by the represented swing. Exemplary tag devices compatible with the present invention include, but are not limited to, those described in U.S. patent application Ser. No. 18/538,679, filed Dec. 13, 2023, which is incorporated herein by reference in its entirety.

In the preferred embodiment of the present invention, the system is comprised of two sub-systems—the tag sub-system and the launch monitor sub-system—together with interfaces and communications that link the two sub-systems and the outputs of the tag device and the launch monitor device. Throughout, unless the context provides otherwise, a reference to the "tag" is not meant to be a reference only to the tag device itself that is affixed to the golf club, but rather is a reference to the tag sub-system. Likewise, a reference to the "launch monitor" is not a reference to the launch monitor unit, but rather a reference to the launch monitor sub-system.

The launch monitor of the present invention measures the launch parameters of a golf ball struck with the swing measured by the tag and generates ball launch data and a predicted ball flight path. The present invention is able to be used in combination with any launch monitor known to those skilled in the art. Examples of launch monitors with which the present invention is compatible include, but are not limited to, those described in U.S. Pat. Nos. 7,395,696, 7,959,517, 8,556,267, 5,471,383, 6,758,759, and 6,781,621, each of which is incorporated herein by reference in its entirety. The present invention is not intended to be restricted to any particular type of launch monitor, and it is capable of being used in combination with launch monitors having any desired characteristics. For instance, the present invention is able to be used with launch monitors having any number or type of ball capture units—for example, radar, photometrics, or other technologies—as well as any type of processors, triggers, lighting units, background surfaces, filters, and the like.

The fundamental function of a golf launch monitor is to capture ball launch parameters, including ball speed, launch angle, and ball spin. This requires the launch monitor to capture the actual ball flight for a period of time, which varies depending on the technology employed. Some launch monitors use radar technology to capture ball flight. The radar unit of the launch monitor measures the ball flight for a sufficient length of time and a processor within the launch monitor system calculates a flight path based on a ballistic flight model. Other launch monitors use photometric technology to capture the ball flight. Launch monitors which use photometrics generally require actual ball flight measurements over shorter down range distances than radar-based technologies. Photometric-based launch monitors use cameras to take pictures of a golf ball as it passes the device's field of view, and based on changes in the pictures, a processor within the launch monitor system is able to calculate a ball flight using a ballistic flight model. Still other launch monitors use a combination of radar and photometrics, and even new or emerging launch monitor technologies will all be seen as being within the purview of the present invention.

In one embodiment, a photometric launch monitor is used, and the launch monitor sub-system is comprised of an imaging unit (e.g., a camera, etc.). This embodiment is also able to include, for example, a housing, a processing device, a trigger, one or more illumination devices, one or more reflective devices, a memory with software loaded thereon, and the like. Various elements of the launch monitor system are able to be operatively connected or coupled as required for a particular embodiment.

In one embodiment, a radar launch monitor is used, such as, for example, one or more continuous wave radar systems or frequency modulated continuous wave radar systems. This embodiment is also able to include, for example, a housing, a processing device, and processing circuitry to process radar signals (e.g., Doppler radar signals), etc.) received by radar receivers. In such embodiments, a struck golf ball is irradiated with radar waves (e.g., Doppler signals, etc.) reflecting off the golf ball and subsequently received, with golf ball trajectory parameters estimated therefrom. Various elements of the launch monitor system are able to be operatively connected or coupled as required for a particular embodiment.

In one embodiment, a ball capture unit of a launch monitor system includes both a radar unit and one or more cameras. This embodiment is able to include, for example, a housing, a processing device, a trigger, one or more illumination devices, one or more reflective devices, a memory with software loaded thereon, and the like, various combinations of which are able to operatively connected as required.

One of ordinary skill in the art will understand that the manner in which the launch monitor measures or acquires the ball launch parameters necessary to calculate a predicted ball flight path is not intended to be limiting according to the present invention. In one embodiment, a ballistics flight model is used to acquire sufficient launch parameter data, i.e., ball launch conditions, to calculate a predicted ball flight path. The launch conditions of the ball such as the components of velocity and spin rate are able to be determined according to mathematical algorithms. In one embodiment, in which photometrics are employed for ball capture, the launch conditions are preferably calculated based on images transmitted to the launch monitor processor from the one or more cameras. In another embodiment, in which radar is employed for ball capture, the launch conditions are preferably calculated based on radar signals that are reflected from a struck golf ball that has been irradiated with radio waves.

In the preferred embodiment, the launch monitor includes a microcontroller having a processor and a memory. The processor is preferably capable of executing computer program instructions. The computer program instructions are able to be bundled as a software package that is loaded onto the computer memory. The present invention preferably includes computer software that is capable of applying a ballistic flight model to the ball launch conditions to derive a predicted ball flight path as well as incorporating the flight path into a golf application program which shows the predicted flight path on a simulated digital golf driving range or a simulated digital golf course.

The tag measures the motion path of a golf club from address through the backswing to the top of the swing, back down to the point of impact with the golf ball and, preferably, through the end of the follow through. Additionally, in communication with a connected computing display device, a processor, based on data from the tag, generates a 2-D or 3-D representation of the motion path—or swing—of the golf club. The present invention is compatible with any tag device capable of measuring sufficient swing parameters of a golf club to recreate a 2-D or 3-D representation of the swing path, which are well known to those skilled in the art. Examples of a tag devices with which the present invention is compatible include, but are not limited to, the SKYPRO by SKYGOLF, and the tag devices described in U.S. patents application Ser. Nos. 13/744,294, 17/987,442, and 18/538,679, and U.S. Pat. Nos. 8,998,717 and 8,905,856, each of which is incorporated herein by reference in its entirety. The present invention is not intended to be restricted to any particular type of tag device which captures the motion path of a golf club and recreates a 2-D or 3-D representation of that motion path, and the present invention is capable of being used in combination with any tag devices having those desired characteristics.

The tag device includes microsensors—such as, for example, accelerometers, gyroscopes, and magnetometers—for measuring the movement of the golf club during a swing and, in communication with a connected computing display device, the tag generates swing parameters and a 2-D or 3-D representation of the swing path of the club.

In one embodiment, the tag is operatively connected to a computing display device, preferably a smartphone, tablet, or other mobile computing device, to further process the sensor data received from the tag and to display the swing representation. The connected computing display device preferably includes a microcontroller with a processor capable of executing software instructions, a memory, and a display. The connected computing display device is also used for initial tag setup, including calibration. In a preferred embodiment, after the initial tag setup and calibration, the processing of the tag sensor data and the displaying of the swing representation is preferably performed on the connected computing display device of the launch monitor through use of a tag software developer's kit ("SDK") associated with the tag, rather than on a connected computing display device of the tag subsystem. The SDK also includes libraries, APIs, integrated development environments, testing tools and compilers, and documentation, among other elements known to those of ordinary skill in the art. In another embodiment, the processing of the tag sensor data output is able to be performed on the connected computing display device of the tag and then the results communicated to the launch monitor for integrating with the launch monitor output and displaying on a connected computing display device of the launch monitor, through use of a tag SDK. One of ordinary skill in the art will understand, unless stated otherwise, such as, for example, in connection with the discussion of the initial tag setup and calibration, the connected computing display device is the connected computing display device of the device performing the processing (i.e., the launch monitor or the tag).

The connected computing display device includes software, such as an SDK, that analyzes the sensor output data received from the tag to generate swing parameters and create a 2-D or 3-D profile of a golf swing. The connected computing display device includes ballistic flight model software, or a physics engine, to generate a recreation of the motion path of the golf club and display the motion path as a swing of the golf club.

In a preferred embodiment, in the initial tag setup, the tag device is calibrated using the tag connected computing display device and employing properties of motion for a rigid body such that features of the golf club are determined. The calibration determines, for example, the club's lie, loft, face normal, face angle, and the distance between the tag device and the club head. One method of calibration is described in U.S. Pat. No. 9,395,385 for Method and apparatus for determining a relative orientation of points on a rigid body by inventors Parke et al, which is incorporated herein by reference in its entirety. After determining the orientation of various points on the golf club relative to the tag device, motion of the golf club in three-dimensional space is analyzed and reconstructed. This permits, for example, the 3-D spatial coordinates of the golf club during a golf swing to be determined and translated to a graphical interface such that a golfer is able to visually analyze features of their golf swing. In another embodiment, the initial tag setup and calibration is performed using the launch monitor connected display device using the same properties of motion as a rigid body.

As stated previously, after initial tag setup and calibration, the relative position and orientation of points on a rigid body (i.e., the golf club), relative to the tag device is able to be determined in advance such that features of a golf swing (e.g., swing plane, club head speed, shaft lean) are subsequently derived based on, e.g., a measured angular velocity, angular acceleration, and/or linear acceleration. That is, if the relative position and orientation of the tag device with respect to the golf club is known, then the movement of the golf club is able to be reconstructed using relationships of motion for a rigid body in an inertial plane. In one embodiment, the physics engine software is run on the microcontroller of the connected computing display device. In another embodiment, the physics engine software is run on a host computer. In the preferred embodiment, the physics engine software is run on the microcontroller of the connected computing display device. Once a swing has been detected, the microcontroller receives from the tag the raw sensor data, referred to herein as "swing data," output by selected sensors on the tag device. The swing data includes the raw angular and linear acceleration data, and the rotation data respectively collected by the selected sensors of the tag device over the course of a swing. In one embodiment, the swing data also includes metadata comprising a time stamp indicating when a swing occurred and time series data for the measured acceleration and rotation. The microcontroller identifies key swing milestones based on the captured swing data. In one embodiment, swing milestones include, e.g., the point of address (the start of the swing), the top of the backswing, the point of impact with a golf ball, and the end of swing follow through. In one embodiment, the swing milestones are used as reference points for performing subsequent motion analysis and reconstruction processing.

In one embodiment, the swing is reconstructed by the microcontroller, based on the swing data, by calculating the translation and rotation of the golf club. As previously discussed, the swing data includes at least time-stamped angular/linear acceleration and rotation measurements from the selected sensors. These measurements are calibrated and corrected for sensor capping, such that they are translated into meaningful values for swing reconstruction. The microcontroller is able to perform an integration of the acceleration and angular velocity throughout the swing. In the case of determining 3-D spatial position, the microcontroller integrates the acceleration once to determine velocity, and then again to determine the position (e.g., coordinates in the x-y-z axes). Similarly, the microcontroller integrates rotation measurement data from at least one rotational sensor (e.g., the gyroscope) once to determine the angular position. In one embodiment, once these translations of the swing data are performed, a reconstruction of the swing is performed such that the swing is able to be displayed visually and/or analyzed (e.g., to find measurements of key swing parameters). Translated swing data used for reconstruction is referred to hereinafter as reconstructed swing data.

In one embodiment, the reconstructed swing data includes, for example, a time series of position, acceleration, and rotation of all points of the golf club during a swing. In one embodiment, this data is presented in absolute terms or is given relative to the position/orientation of the tag device. The time series starts at an address and ends at the point of impact or follow through, and each point in the time series is able to be analyzed to determine swing parameters (e.g., orientation and position of the club in 3-D space). Non-limiting examples of swing parameters that are then able to be calculated by the microcontroller include swing plane, swing tempo, swing velocity, swing force, impact force, club face angle, club face orientation, club head speed, point of ball impact, clubhead loft, hand speed, velocity of a golf club, a trajectory of a golf ball, angle of impact between the golf club and the golf ball, a face angle of the golf club at impact with the golf ball, a club path during a golf swing, shaft lean at impact, shaft lean at address, shaft angle at top of backswing, and/or plane skew offset. Further, the reconstructed swing data is able to be translated such that the information included therein is represented graphically as a reconstructed swing "replay" on a display screen.

The microcontroller utilizes the reconstructed swing data described in the foregoing exemplary processing to graphically display a reconstructed swing "replay" and/or the swing parameters, preferably in connection with display of the predicted ball flight path associated with the swing which is generated by the launch monitor. The graphical swing reconstruction includes retrieving the reconstructed swing data time series and building a 2-D or 3-D view in which the club is mapped to the connected device's display based on the timeline and an indexing of the timeline. Alternatively, or in conjunction with the 3-D reconstruction, the microcontroller displays calculated swing parameter numbers, such as club head speed, for any club position on the timeline. All data associated with the reconstructed swing is able to be stored in the memory of the connected device or communicated to and/or stored in the memory of another computing device for later use and/or for comparisons between a current swing and a past swing. One example of such a physics engine is described in U.S. Pat. No. 8,905,856 by inventors Parke et al., which is incorporated herein by reference in its entirety.

The interface and communication units of the present invention link the outputs of the tag and the launch monitor, permitting the system of the present invention to integrate the results of the tag and the launch monitor and display, on a connected display device, such as a personal computer, a tablet, a smartphone, or another mobile computing device, a 2-D or 3-D representation of the swing as well as a predicted flight path of the golf ball struck with the represented swing. The integrated results are communicated to and stored in central computers or servers that serve the tag sub-system and/or the launch monitor sub-system.

The communication between the tag and the launch monitor is preferably by wireless communication. In one embodiment, the communication unit of the tag is a BLUETOOTH (or another wireless personal area network (WPAN)) transmitter operable to use BLUETOOTH LOW ENERGY (BLE) protocols, and the communications unit of the launch monitor is also a BLUETOOTH transmitter operable to use BLE protocols. In one embodiment, the communication units of the tag and the launch monitor are operable for communicating with each other and other external devices, such as display devices, mobile devices, interfacing devices, and/or tablets via BLUETOOTH or any other suitable wireless protocols. The communication units of the tag and launch monitor are further operable to send and receive signals using BLE protocols. The communication units include a transmitter operable to communicate with devices using radio waves. One of ordinary skill in the art will appreciate that while BLE is the preferred means of communication between the tag and launch monitor, other forms of wireless communication also fall within the scope of the present invention.

In the preferred embodiment of the present invention, when the tag device is originally manufactured, the tag device is embedded with digital information identifying the tag device. The tag device is given a unique digital identifier number, such as a media access control (MAC) address or machine identifier number. Additionally, because the tag device in the preferred embodiment uses BLUETOOTH protocols for communication, the tag device is given a unique BLUETOOTH identifier, known as a universally unique identifier (UUID). The BLUETOOTH related identification information also includes other BLUETOOTH-specific information, such as the tag device company's BLUETOOTH Special Interest Group (SIG) identifier.

During the tag device calibration process generally described herein, the tag device is in communication with the golf application program of, preferably, the tag connected computing display device. During the calibration process, information about the tag device and the golf club to which it is attached is collected and stored in the memory of the tag device and the connected computing display device. In the preferred embodiment, this includes the tag owner's customer identification number (i.e., the customer identification number given to the tag owner by the tag device company), the club type (e.g., driver, 5-iron, putter, pitching wedge, etc.), club characteristics (e.g., loft, lie, etc.), the tag device firmware version number, and/or the sensor configuration and calibration information regarding the sensors on the tag device. This information is referred to as the golf application data and/or as the tag device fingerprint. Once embedded within the memory of the tag device and the tag connected computing display device, this golf application data is also communicated by the tag connected computing display device to the tag device company's central database. A single golfer's collection of tag device fingerprints for all of his or her golf clubs with an attached tag is collected and stored in the tag company's central database and is referred to as the golfer's "bag." After an initial setup, this information is communicated to the launch monitor connected computing display device.

Referring now to the drawings in general, the illustrations are for the purpose of describing one or more preferred embodiments of the invention and are not intended to limit the invention thereto.

FIG. 1 is a high-level schematic diagram of a system able to access data from a launch monitor as well as a tag device according to one embodiment of the present invention. The system 100 of the present invention includes a tag subsystem 101 and a launch monitor subsystem 102. The tag sub-system 101 includes a tag device 103, which is attached to a golf club and includes micro-sensors, such as, for example, one or more of an accelerometer, a gyroscope, a magnetometer, or a piezo, which measure movement of the golf club. The tag device 103 is in communication with a remote connected computing device 111 to further process the tag device 103 sensor output data and, for example, generate a motion path of the golf club and/or a 2-D or 3-D swing representation. However, in a preferred embodiment of the present invention, after initial tag setup and calibration, the processing normally done by remote connected computing device 111 to generate a swing path and graphic representation of the swing is performed, instead, by the tag device software development kit (SDK) 107, which is part of the launch monitor application program 106.

The tag sub-system 101 includes a central computer or server 105 that includes a database of certain tag and swing information, including golfer bags, (e.g., the club name and type of each of a golfer's clubs with associated tag IDs). The tag sub-system 101 also includes an application program interface (API) 104 that permits the launch monitor application to communicate with and/or transmit data to the tag central computer or server 105 through a connected network (e.g., a cloud network).

The launch monitor sub-system 102 includes a launch monitor device 109 that is capable of measuring the launch parameters of a struck golf ball. In one embodiment, the launch monitor device 109 utilizes radar, photometrics, a combination of radar and photometrics, or other technologies known in the art to measure the ball launch parameters. In one embodiment, the measured launch parameters necessary to predict a ball flight path include ball speed, launch angle, and ball spin. The launch monitor device 109 is in communication with a computing device 108, such as a personal computer or a tablet, smartphone, or other mobile computing device, which includes a microprocessor, a memory, a display, and a golf application software program 106. The golf application program 106 includes a tag device SDK 107, which is programmed to receive sensor output data from the tag device 103 and generate a motion path of the golf club swing and/or a 2-D or 3-D representation of the golf swing resulting in a strike of the golf ball measured by the launch monitor device 109. The launch monitor application program 106 also includes a ballistic flight model or physics engine to generate a predict ball flight path of a struck golf ball. The launch monitor application program 106 is in communication with a launch monitor central computer or server 110 that includes a database of certain launch monitor and ball flight information. One of ordinary skill in the art will understand that although the launch monitor central server 110 and the tag device central server 105 are depicted as separate in FIG. 1, these two elements are also able to be represented by a single server storing both tag device and launch monitor data.

Figure 2:
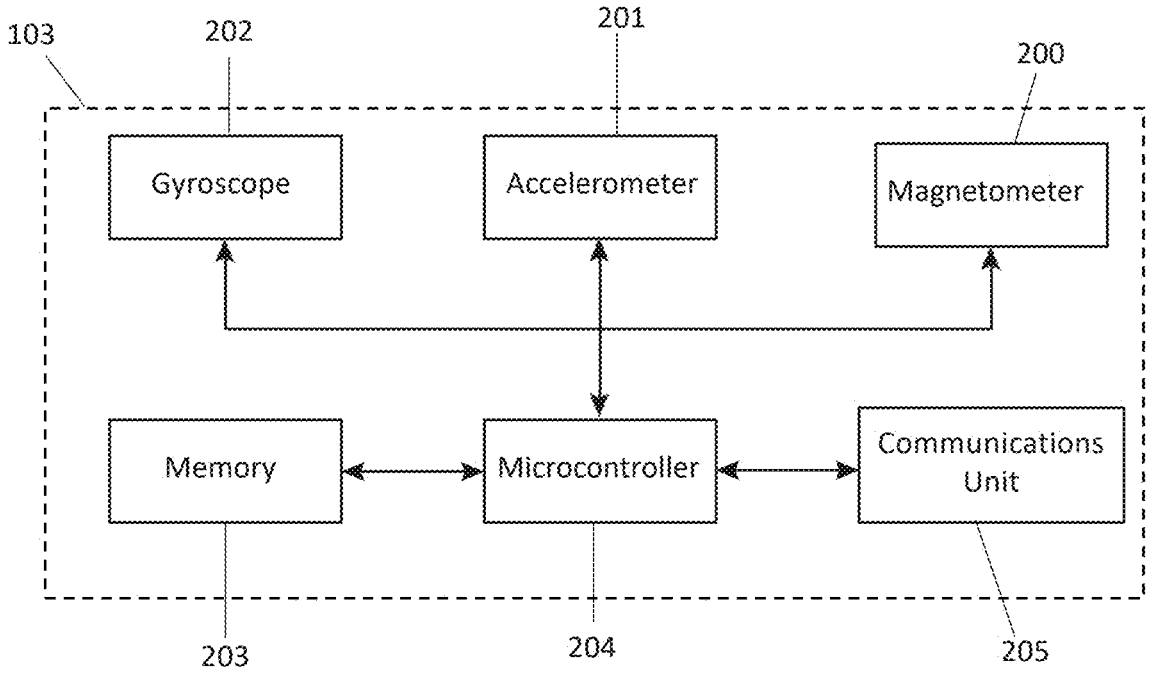
FIG. 2 illustrates a block diagram of the electronic architecture of a tag device according to one embodiment of the present invention.

FIG. 2 illustrates a block diagram of the electronic architecture of a tag device according to one embodiment of the present invention. In this embodiment, the tag device 103 includes a microcontroller 204, a gyroscope 202, an accelerometer 201, a magnetometer 200, a memory 203 and a communications unit 205. The tag device also preferably includes a battery for powering the various elements of the device, which is not shown in FIG. 2. In a preferred embodiment, the gyroscope 202 and the accelerometer 201 are included as part of an inertial measurement unit (IMU). In a preferred embodiment, the gyroscope 202, the accelerometer 201, and the magnetometer 200 constitute the IMU, which is operable to measure the movement, speed, acceleration, and orientation of the tag device 103 in three dimensions relative to the earth's magnetic field. The tag device 103 is further operable for capturing, storing, and processing sensor data, then transferring the processed sensor data to a microcontroller 204 for transmission via BLE protocols.

In one embodiment, the microcontroller 204 is an ultra-low power system on a chip (SoC) microcontroller that includes the communication unit 205, the memory 203, and a microprocessor. The microcontroller 204 is operable to receive sensor data from at least one of the gyroscope 202, the accelerometer 201, and the magnetometer 200. The microcontroller 204 is further operable to store and execute operational instructions and processes, such as the sensor data, according to pre-determined logic and algorithms, as well as, temporarily storing processed sensor data and transmitting the processed data via BLE.

In one embodiment, the magnetometer 200 is a monolithic integrated 3-axes device operable to measure the strength and direction of magnetic fields. In a preferred embodiment, the magnetometer 200 is operable to sense the position and orientation of the tag device 103 in relation to the earth's magnetic field.

In one embodiment, the accelerometer 201 is a 3-axis, 3-D configurable state accelerometer. The accelerometer 201 is operable to measure linear acceleration and/or tilt.

The accelerometer 201 is further operable to measure the speed, acceleration, and/tilt of the tag device 103 in three axes.

In one embodiment, the gyroscope 202 is a 3-axis gyroscope and is operable to measure motion around an axis, including the angular velocity of the tag device 103 with respect to a given axis. The gyroscope 202 is further operable to provide data regarding the location and orientation of the tag device 103.

In one embodiment, the communication unit 205 is a BLUETOOTH transmitter operable to send and receive signals via BLE protocols. In one embodiment, the communication unit 205 is operable for communicating with other external devices, such as display devices, mobile devices, interfacing devices, tablets, or other devices.

In one embodiment, the memory 203 includes, but is not limited to, volatile and non-volatile media such as cache, random-access memory (RAM), read-only memory (ROM), erasable programmable read-only memory (EPROM), electrically erasable programmable read-only memory (EEPROM), flash memory, or other solid state memory technology. One of ordinary skill in the art will understand that the memory 203 is not intended to be limited to any particular type of memory and is compatible with any suitable form of memory known in the art.

Figure 3A:
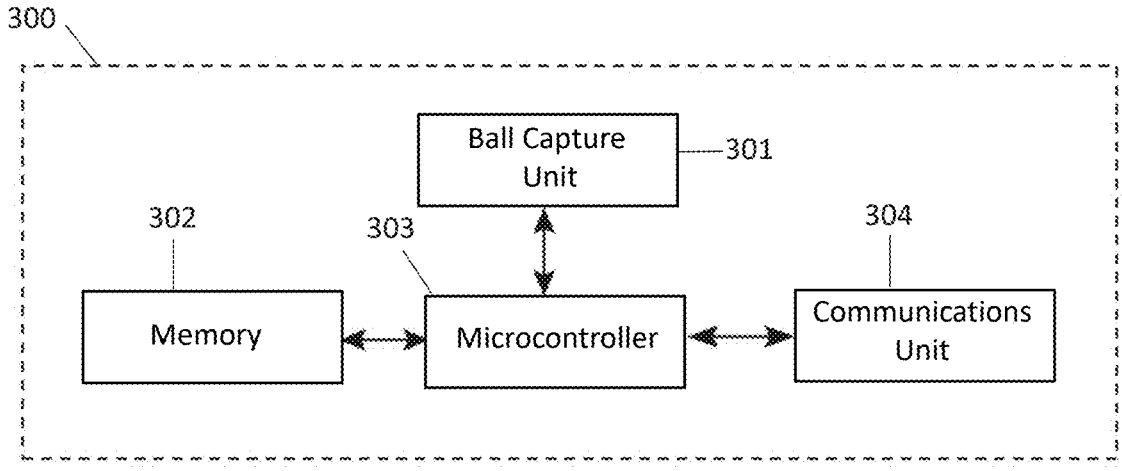
FIG. 3A illustrates a block diagram of an electronic architecture of a launch monitor according to one embodiment of the present invention.
Figure 3B:
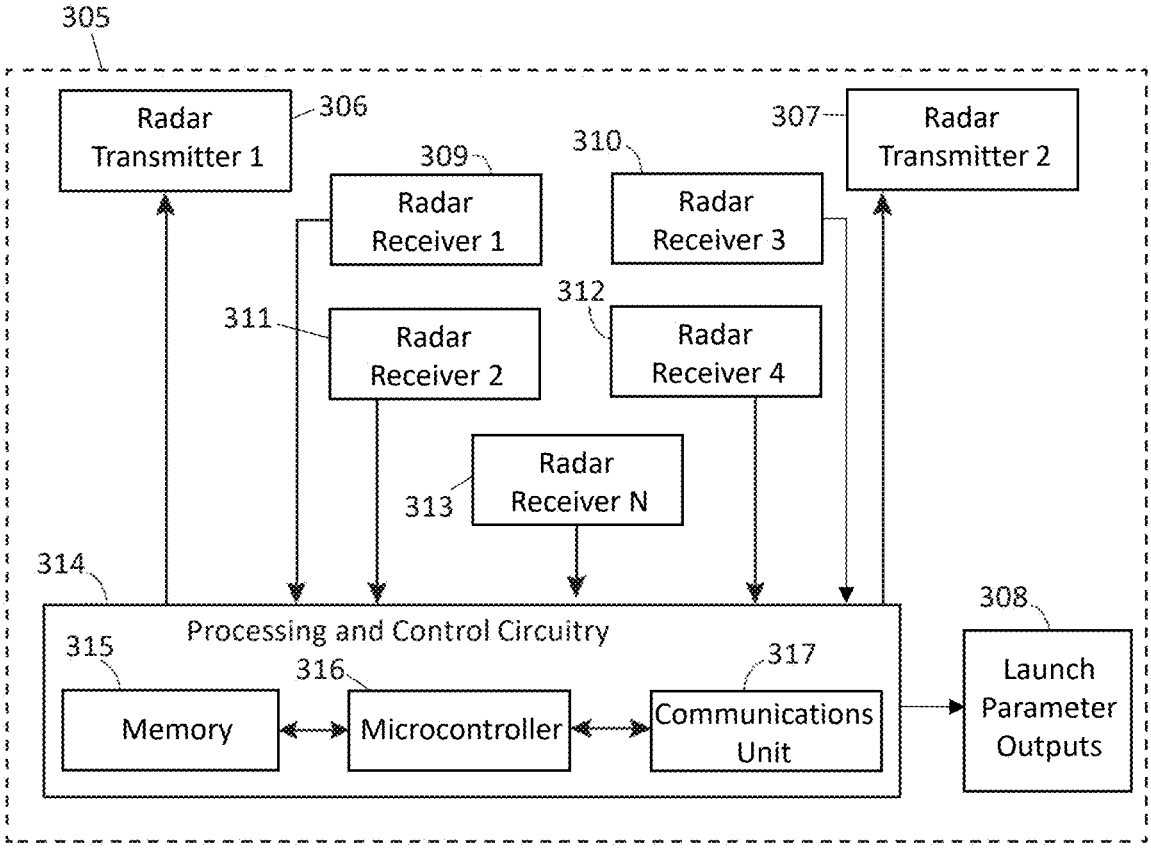
FIG. 3B illustrates a block diagram of an electronic architecture of a radar-based launch monitor according to one embodiment of the present invention
Figure 3C:
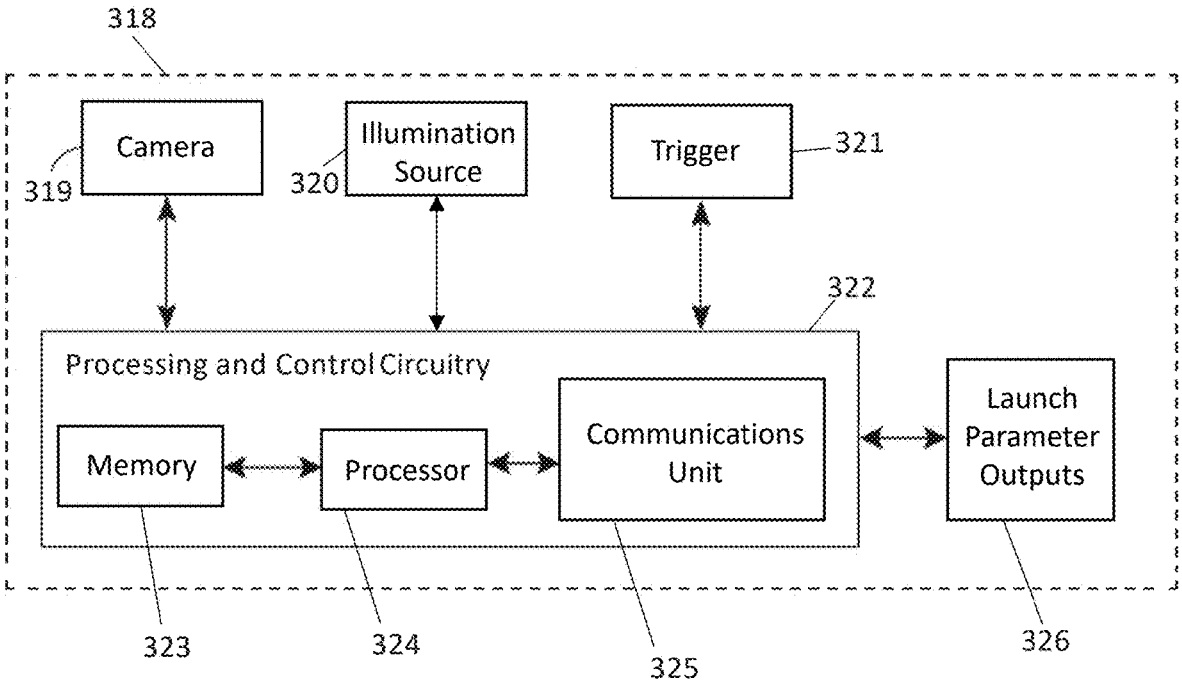
FIG. 3C illustrates a block diagram of an electronic architecture of a photometric-based launch monitor according to one embodiment of the present invention

FIGS. 3A, 3B, and 3C illustrate block diagrams of the electronic architecture of a launch monitor device according to various embodiments of the present invention. FIG. 3A illustrates a block diagram of the electronic architecture of a launch monitor according to one embodiment of the present invention. The launch monitor 300 includes a ball capture unit 301, a memory 302, a microcontroller 303, and a communications unit 304. The ball capture unit 301 is able to include any subassembly capable of measuring the launch parameters of a struck golf ball, such, as, for example, a camera, a radar unit, and/or capture systems. The ball capture unit 301 captures measurements of a struck golf ball, then communicates those measurements to a microcontroller 303 with a processor and processing circuitry which is configured to calculate the golf ball's launch parameters. Once the parameters are determined, they are then saved to the memory 302 and/or communicated to other display devices via the communications unit 304.

FIG. 3B illustrates a block diagram of the electronic architecture of a radar-based launch monitor according to one embodiment of the present invention. The launch monitor 305 includes two radar transmitters 306, 307. In other embodiments, the launch monitor includes more or less than two radar transmitters. The radar transmitters 306, 307 are able to be of several types of radar known to those of ordinary skill in the art, including, for example, continuous wave radar systems and/or frequency modulated continuous wave radar systems. Moreover, the radar transmitters 306, 307 are able to be the same type of radar or different types of radar from each other. The launch monitor 305 also includes a plurality of radar receivers 309, 310, 311, 312, 313 and processing and control circuitry 314, which processes radar reflections that are acquired by the radar receivers 309, 310, 311, 312, 313. The processing and control circuitry 314 includes a microcontroller 316 controlling a processor, one or more memory devices 315, and a communications unit 317. The processing and control circuitry 314 outputs launch parameters 308 regarding the characteristics of the flight path of the struck golf ball. In one embodiment, the struck golf ball is irradiated with radar waves from radio transmitters 306, 307, the radio receivers 309, 310, 311, 312, 313 receive reflecting signals, which are returned to the processing and control circuitry 314, which then processes the signals and calculates ball launch parameters.

FIG. 3C illustrates a block diagram of the electronic architecture of a photometric-based launch monitor according to one embodiment of the present invention. The launch monitor 318 includes at least one camera 319. In one embodiment, the launch monitor 318 includes a plurality of cameras. More cameras generally provide greater resolution and a larger field of view. However, a single camera 319 that takes multiple images of the struck golf ball falls within the scope of launch monitors 318 acceptable for use in the present invention. In one embodiment, the launch monitor 318 includes a trigger 321 to trigger the at least one camera 319. In another embodiment, more than one trigger is able to be employed. Multiple triggers are useful because they are able to be configured for both right-handed and left-handed golfers, thereby eliminating the need to change the launch monitor's direction depending on whether the golfer is right-handed or left-handed. In one embodiment, the launch monitor 318 also includes an illumination source 320. In one embodiment, the illumination source 320 includes an infrared (IR) light array, one or more light emitting diodes (LED), or any other suitable light source. The launch monitor 318 also includes processing and control circuitry 322, which includes at least one processor 324, at least one communications unit 325, and one or more memory devices 323. The processing and control circuitry 322 is able to be configured such that the at least one processor 324 executes computer instructions in which the ball image outputs of the at least one camera 319 are analyzed and the launch parameters of the struck ball are calculated and then transmitted to other display devices via the at least one communications unit 325 as launch parameter outputs 326.

Figure 4:
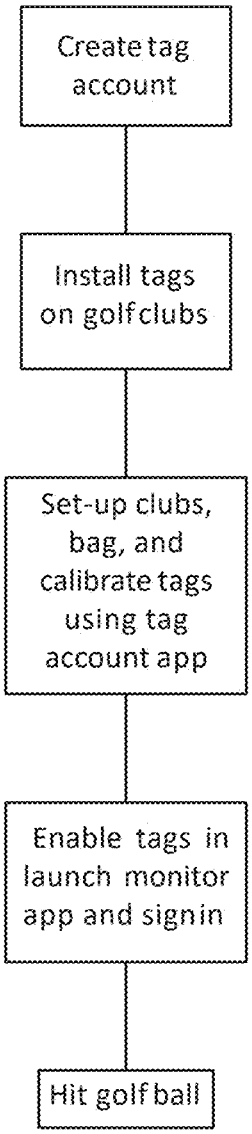
FIG. 4 illustrates a flowchart for initial setup of tags for use in the system according to one embodiment of the present invention.

FIG. 4 illustrates the flowchart for initial setup of the tags according to one embodiment of the present invention. In the embodiment illustrated in FIG. 4, the initial tag setup is performed using an associated connected computing display device for the tag. In another embodiment, not illustrated, the initial setup is performed with an associated connected computing display device of the launch monitor, and the information acquired through the setup process is communicated through the tag API to the tag system. One of ordinary skill in the art will appreciate that, regardless of the sub-system used for the initial tag setup and calibration, the resulting setup and calibration information must be submitted to and stored within the tag sub-system if the tag and the launch monitor do not employ a single central database.

In the embodiment illustrated in FIG. 4, after acquiring a tag, or more commonly a set of tags, the golfer creates an account with the tag and optionally downloads a tag application on a computer, a smartphone, a tablet or another computing device. A username and password for access to the golfer account is selected, along with other information. In one embodiment, tag use requires a recurring subscription or membership, and the required subscription is purchased during the initial setup or when the tags are acquired. After an account is created, the tags are installed on each of the golf clubs in accordance with the installation instructions for the tags. After the tags are installed on the golfer's clubs, using the tag application, each individual tag is then registered or associated with the golf club on which it is installed, and each tag is calibrated. Once calibrated, in the remainder of the setup process, each tag fingerprint is registered in the tag database, including, for example, the tag owner's customer identification number (i.e., the customer identification number unique to the tag owner), the club type (e.g., driver, 5-iron, putter, pitching wedge, etc.), the club characteristics (e.g., loft, lie, etc.), the tag device firmware version number, the sensor configuration and calibration information regarding the sensors on the tag device, the unique BLUETOOTH data specific to the tag (and/or a manufacturer or seller of the tag), and the unique tag specific identifying data or MAC address. Once this step is completed, the initial setup and calibration is complete. In one embodiment, before the tags are ready for use with the launch monitor, tag integration must be enabled in the launch monitor app running the tag SDK. After tag integration is enabled in the launch monitor app, the launch monitor app is ready to operate.

Figure 5:
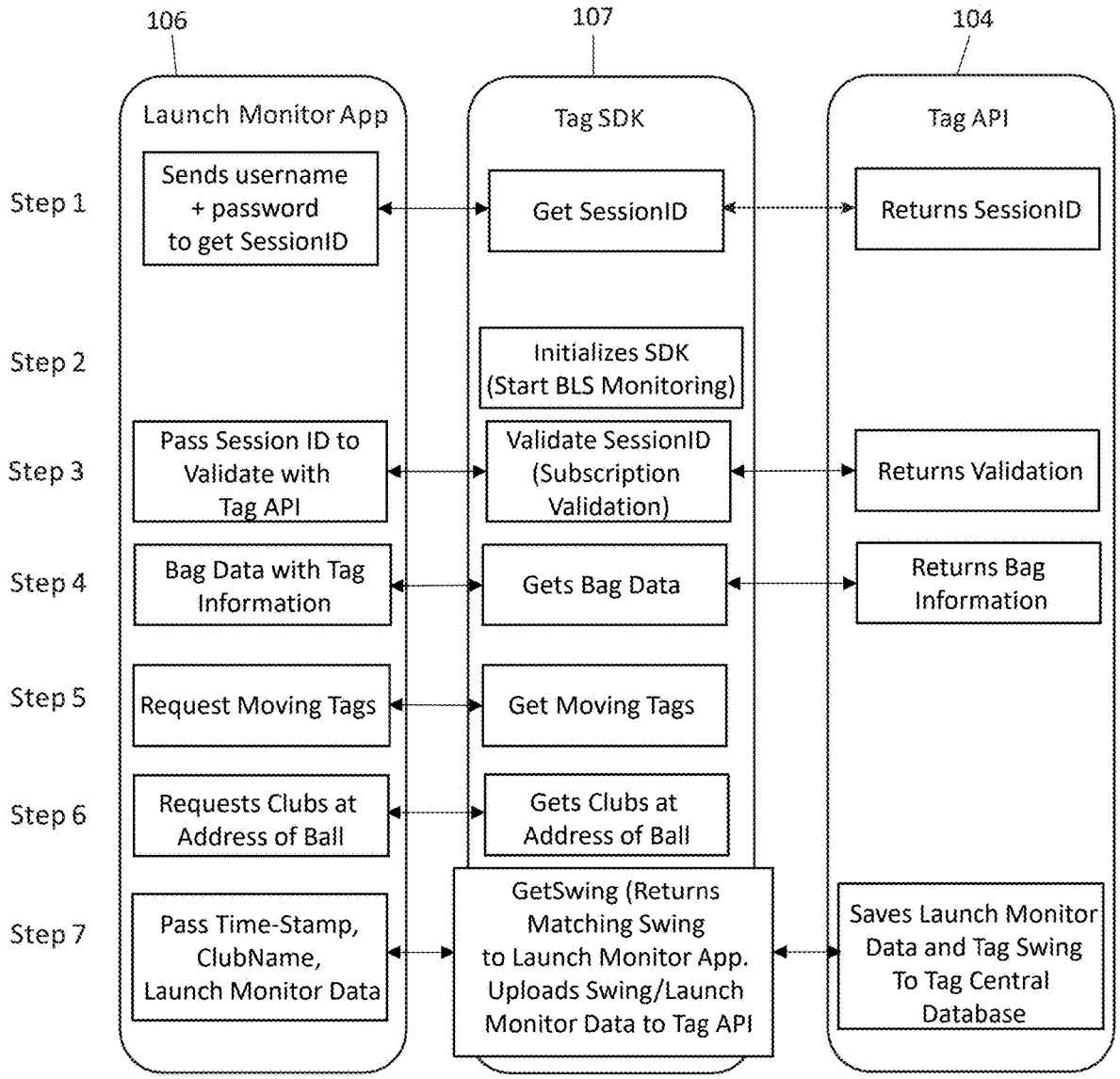
FIG. 5 illustrates an interface workflow according to one embodiment of the present invention.
Figure 6:
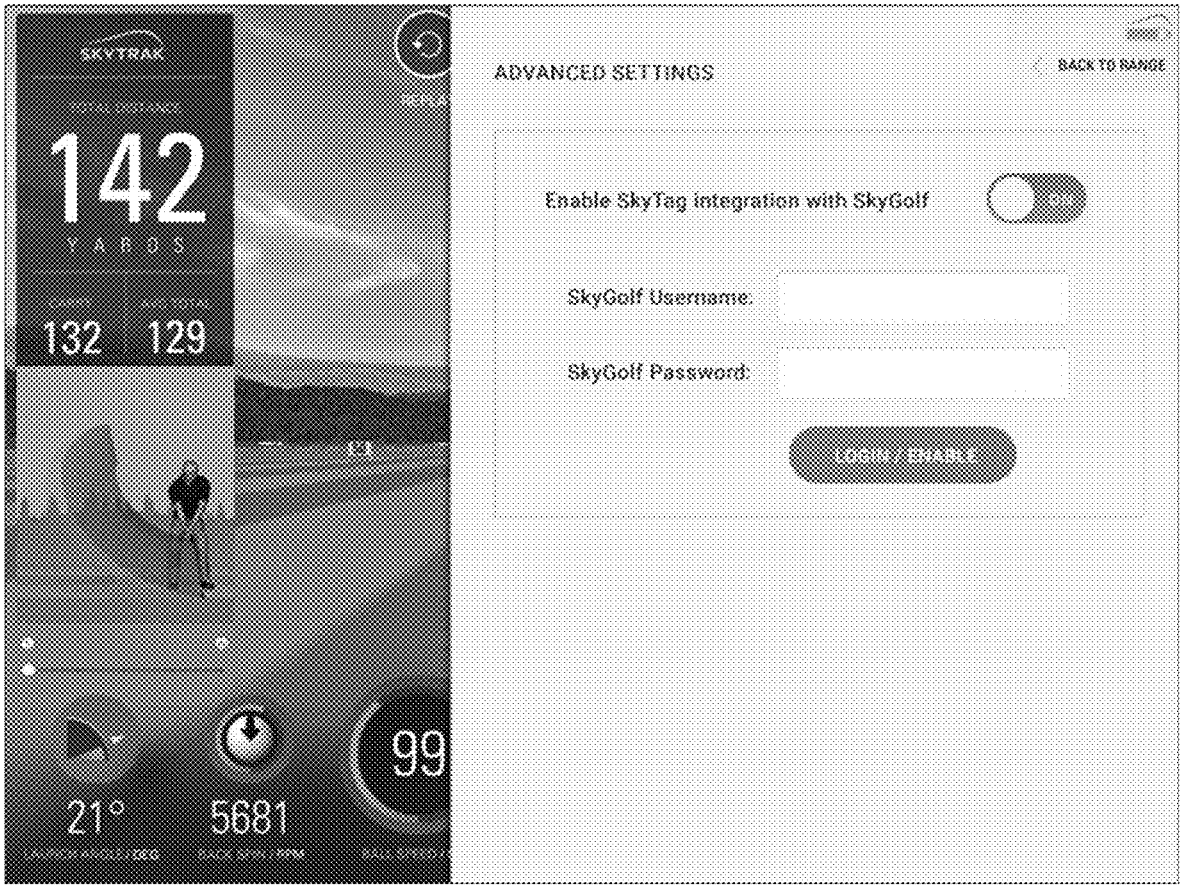
FIG. 6 illustrates a log-in page of a launch monitor application graphical user interface (GUI) according to one embodiment of the present invention.
Figure 7:
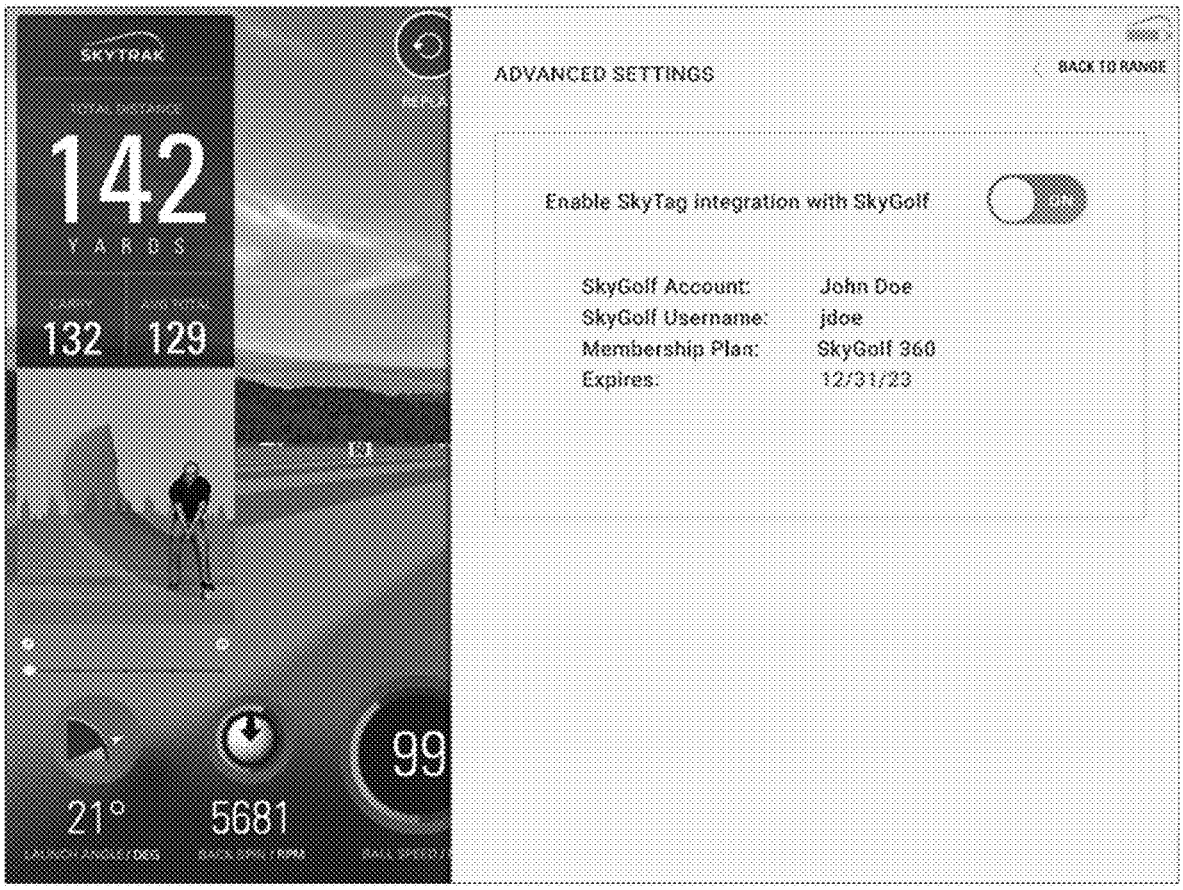
FIG. 7 illustrates a profile page of a launch monitor application GUI according to one embodiment of the present invention.

FIG. 5 illustrates the interface workflow according to one embodiment of the present invention. In one embodiment of the present invention, the system includes a launch monitor application program 106 with a tag SDK 107 which is in communication with a Tag API 104. When the golfer is ready to hit golf balls using the system of the present invention, the launch monitor application program 106 (the "launch monitor app") is opened on the launch monitor connected computing display device. Integration with the tags is then enabled or initialized on a page of the launch monitor app 106 for that purpose. FIG. 6 illustrates an exemplary embodiment of the launch monitor app page for enabling tag use with the launch monitor. The enablement page of the launch monitor app includes a digital toggle switch to toggle on and off use of tags with the launch monitor. If the golfer does not wish to use tags with the launch monitor, the switch is toggled to the off position. If the golfer wishes to use tags with the launch monitor, the switch is toggled to the on position. The tag account username and password are then entered and the digital login/enable button is selected. This starts the integration workflow as described in FIG. 5 at either Step 1 or Step 3, as described below. In one embodiment of the present invention, if the golfer's tag account is validated, the launch monitor app additionally displays the golfer's basic account information, as illustrated in FIG. 7. As used in the Figures herein, for convenience of understanding the Figures and the specification relating thereto, "SkyGolf" is the tag company, and "SkyTrak" is the launch monitor company.

Returning to FIG. 5, in one embodiment of the present invention, tags are assigned a SessionID for use with a launch monitor, and the SessionID is stored in the tag SDK 107 and/or memory of the launch monitor app 106. The SessionID is the tag account login information which identifies the user's tags and associated tag account. It is the basic authentication of a user's tags. In one embodiment, the SessionID assigned is permanent, and once a SessionID is initially assigned to a user and his or her tags and tag account, it does not need to be assigned again as long as the tag account and/or subscription is maintained. In another embodiment, the SessionID expires after a period of time, and the process to assign a SessionID is repeated at the end of the time period if the user maintains his or her tag account and subscription. Whether the tag/launch monitor workflow begins at Step 1 or Step 3 depends on whether a valid SessionID has already been assigned.

In one embodiment, where the golfer is using the tags with the launch monitor for the first time or a valid SessionID otherwise does not exist, at Step 1 of FIG. 5, when the golfer enables tag use in the launch monitor app 106, the launch monitor app 106, via the tag SDK 107, requests a SessionID from the tag API 104. If there is a valid tag account and subscription, the tag API 104 assigns a SessionID and returns the SessionID to the launch monitor app 106, again via the tag SDK 107. Once a valid SessionID is assigned and returned to the launch monitor app 106, the tag SDK 107 is initialized or enabled for use with the launch monitor at Step 2, and the tag SDK 107 begins BLUETOOTH monitoring for tags. In subsequent use of tags with the launch monitor, a SessionID will not need to be assigned again, except in embodiments in which the SessionID is time limited and the time period has expired.

In one embodiment, where the golfer has previously used the tags with the launch monitor and a valid SessionID exists, the tag/launch monitor workflow begins at Step 3 instead of Step 1. In that use case, Step 2 follows Step 3 rather than preceding Step 3. In the use case of subsequent tag use and existing valid SessionID, at Step 3, when tag use is enabled in the launch monitor app 106, the launch monitor app 106, via the tag SDK 107, requests validation of the stored SessionID. If the stored SessionID is valid, the tag API 104 returns a validation to the launch monitor app 106, again through the tag SDK 107. Once a valid SessionID is assigned and returned to the launch monitor app 106, the tag SDK 107 is initialized or enabled for use with the launch monitor, and the tag SDK 107 begins BLUETOOTH monitoring for tags.

At Step 4, the launch monitor app 106 then requests from the tag API 104, via the tag SDK 107, the tag information for the tags in the golfer's "bag,", which is the collection of tag fingerprints for each tag in the golfer tag account, including most importantly the club type and other club information for each club with an associated tag. The tag API 104 then returns this bag information to the launch monitor app 106 through the tag SDK 107.

In one embodiment, the present invention is able to automatically detect which club the golfer uses in connection with the launch monitor based on the movement and orientation signature of the club detected by the tag sensors. As previously discussed, when the sensors on a tag detect movement or a pre-determined orientation of the tag, the tag begins BLUETOOTH advertisement indicating that the tag is moving and/or is in the pre-determined orientation. At Step 5, the launch monitor app 106 requests from the tag SDK 107 the tag information for any tags that are moving, and the tag SDK 107 returns the tag information for any of the tags in the golfer's bag that are moving. At Step 6, the launch monitor app 106 then requests from the tag SDK 107 the tag information for any tags that are oriented in the address position, which is the position at which the club is ready to be swung to strike the ball. In another embodiment, the club and the associated tag that the golfer uses in connection with the launch monitor is not automatically detected. In that embodiment, the information is manually entered into the launch monitor app 106, including the club being used so the launch monitor app 106 and tag SDK 107 are able to identify the tag being used.

After the golfer hits a ball, the launch monitor detects the ball launch and, as previously discussed, stores the ball launch parameters, a time stamp of the ball launch, and the generated predicted ball flight path. At Step 7, the launch monitor app 106 passes the time stamp, club name of the club used to strike the ball, and other launch data output by the launch monitor to the tag SDK 107. The tag SDK 107 then retrieves the swing data (i.e., the swing parameters and motion path of the swing) of the swing matched, preferably by time stamp, to the ball strike resulting in the launch monitor launch data. The tag SDK 107 then returns the swing data to the launch monitor app 106 and uploads the swing data and launch monitor output data to the tag API 104, which transmits the swing and launch monitor data to the tag central server.

Figure 8:
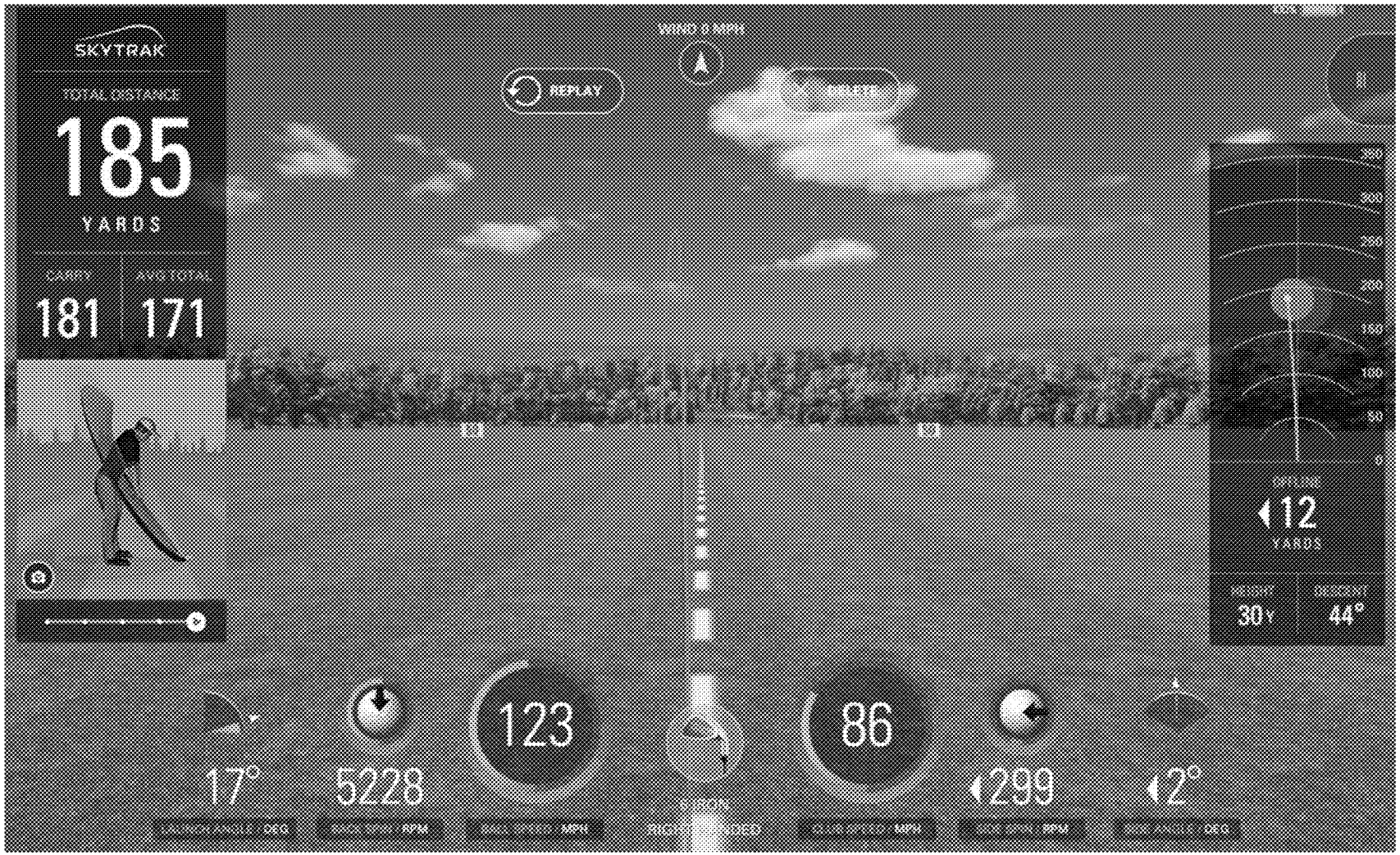
FIG. 8 shows a simulated golf driving range interface of a launch monitor application GUI incorporating data output from a tag and a launch monitor according to one embodiment of the present invention.

Once the swing data is matched to the launch monitor data, the two are combined in a single application program (e.g., the launch monitor app) and displayed in a single display output. FIG. 8 illustrates an exemplary embodiment of a digital display of a connected computing display device showing the tag output and launch monitor output combined in a single program display according to one embodiment of the present invention. The tag data output and launch monitor data output are simultaneously displayed in a simulated golf driving range in a launch monitor app. The digital driving range thus includes the predicted ball flight of the measured ball strike overlaid on the display. The numbers displayed at the bottom of FIG. 8 include the launch monitor ball launch parameters and one club parameter, including, for example, launch angle in degrees, backspin RPM, ball speed (in mph), club velocity (in mph), and side angle degrees. The numbers on the right side of FIG. 8 show the distance the ball flight is off a centerline as well as its total flight height and descent angle, and the numbers on the left side of FIG. 8 show the total distance of the ball flight, the carry distance (i.e., the distance the ball travels in the air) and the average total distance of previous ball strikes using the same club. In one embodiment, the club used is also shown.

On the left side of FIG. 8, the swing path data from the tag for the swing that produced the predicted ball path is also shown. In one embodiment, a slider below the swing representation permits the user to put the swing in motion, showing the swing from address to the top of the backswing down through impact with the ball and through the follow through after impact. The slider is able to be toggled manually, or it is used as a "play" button, causing the swing to be depicted in a "movie" of the swing. In one embodiment, the swing representation is moved with a connected computing display device input device, such as a touch screen, to see different angles of the swing. In one embodiment, clicking on the swing representation with a connected computing display device input device, such as a touch screen, reveals the numerical swing parameters, such as, for example, swing tempo, club face angle, club face orientation, club head speed, clubhead loft, hand speed, velocity of a golf club, face angle of the golf club at impact with the golf ball, shaft lean at impact, shaft lean at address, and/or shaft angle at top of backswing.

Figure 9:
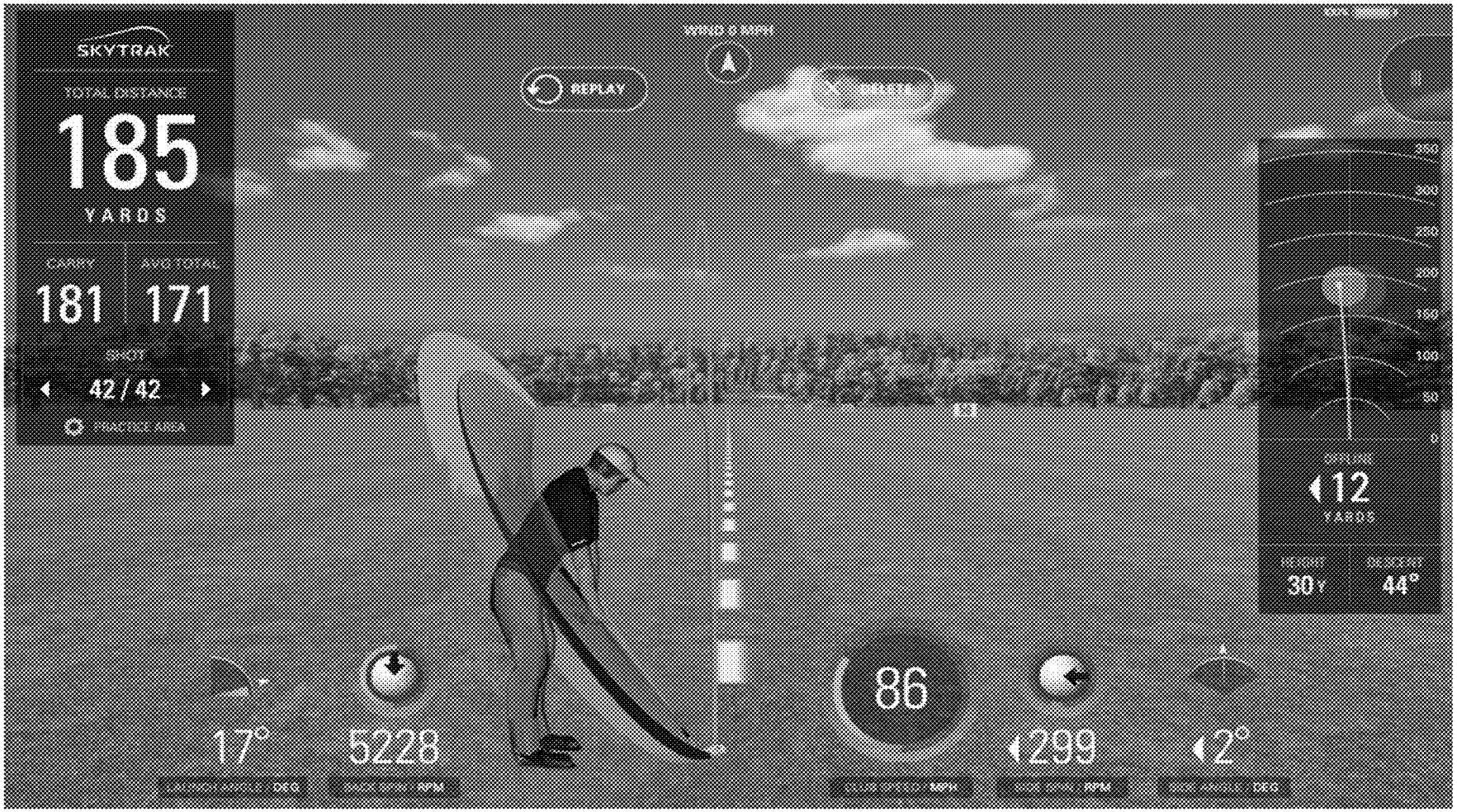
FIG. 9 shows a simulated golf driving range interface of a launch monitor application GUI incorporating data output from a tag and a launch monitor according to one embodiment of the present invention.

FIG. 9 illustrates an exemplary embodiment of a digital display of a connected computing display device showing the tag output and launch monitor output combined in a single program display according to one embodiment of the present invention. FIG. 9 presents the same launch monitor data and tag data as illustrated in FIG. 8, but the location of the tag swing representation is moved to the center and bottom of the display to align the golfer icon's address of the ball with the centerline of the simulated golf driving range from which the predicted ball flight path originates and is displayed in a larger format. This provides a truer representation of the golfer's swing and the predicted ball flight path.

Figure 10A:
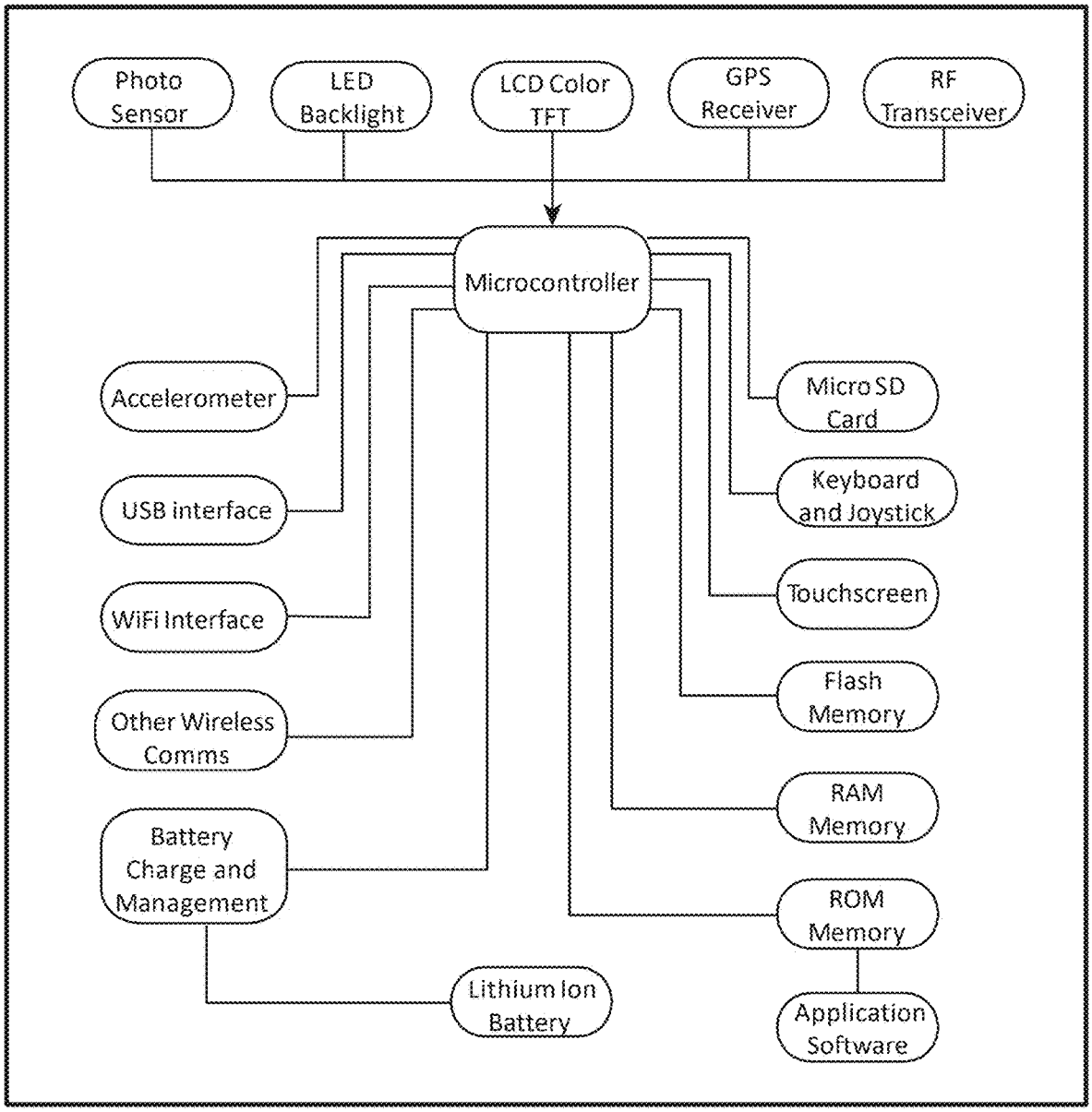
FIG. 10A illustrates a configuration of distributed computing devices able to be used with the present invention.

An exemplary configuration of one of the distributed computing devices able to be used with the present invention, including, for example, as a connected computing display device, is shown and described with reference to FIG. 10A. The computing device is able to include a hand-held device including multiple components that are managed by microcontroller running software stored in a flash memory or random-access memory, for example. The microcontroller serves as an interface and controller for a plurality of hardware systems and device application systems of the remote computing device. In an exemplary embodiment, the primary purposes of the computing device are to further process the sensor output data received from the launch monitor device and/or the tag device and to provide a display to visualize the predicted flight path and launch parameters derived from the launch monitor output data, the swing depictions derived from tag device sensor output data, and/or the combination of the predicted flight path and launch parameters and swing depiction.

The computing device is able to be a location-aware device for use with tags in a standalone implementation that does not interface with the launch monitor. In such implementation, distance information is provided to the user by referencing geolocated mapped data stored in the flash memory, for example, to the real time Global Positioning System (GPS) geolocation data acquired by an onboard GPS receiver. The microcontroller processes the GPS data and derives calculations to the mapped points and various areas on the course. The computing device includes a display, which is able to include a sunlight readable color thin-film transistor (TFT) liquid crystal display (LCD) display having a light-emitting diode (LED) backlight. The LED backlight is controlled by a photosensor that measures ambient light and adjusts the brightness of the backlight accordingly.

The microcontroller receives input from the user via a user input device, such as a touchscreen, a button, a keyboard, a mouse, a joystick, or an audio-activated input device. The user input corresponds to, for example, a command to move a cursor on the graphical user interface, enter data, select a particular course for display, select a shot to pull up a sub-screen with additional shot data or a swing depiction, or otherwise control the remote computing device.

The computing device includes an onboard flash memory, which is able to be updated via connection of a Universal Serial Bus (USB) port, micro-Secure Digital (micro-SD) card, WI-FI radio or other wireless communications device. An operating system of the microcontroller and various applications executed by the microcontroller are also able to utilize the onboard RAM for storage of temporary data.

The computing device is powered by a battery that is managed by a charging circuit and power management circuit to provide power to the various components of the location-aware device. The remote computing device also includes a radio-frequency (RF) transceiver that receives signals transmitted from the tag devices.

Data transmitted from the tag device is received by the computing device transceiver and is further processed by the microcontroller. The microcontroller analyzes the sensor output data received from the tag device to determine if the output matches a pattern of data indicating a swing of the golf club and/or a ball strike event. The microcontroller compares the received sensor output data against stored "signatures" or reference values corresponding to a swing and/or ball strike event to determine whether a swing or ball strike event has occurred. The remote computing device also includes a "physics engine," which is software operable to render a 2-D to 3-D image of the swing.

This data, including as further processed, is stored in a memory (e.g., flash memory and/or RAM memory) and is used by the microcontroller to automate the scoring process, display the round and shot data graphically on the device, and is available to upload the data to a computer and/or website for post-round analysis and graphical tracking of the player's golf shots over the course of a round.

Figure 10B:
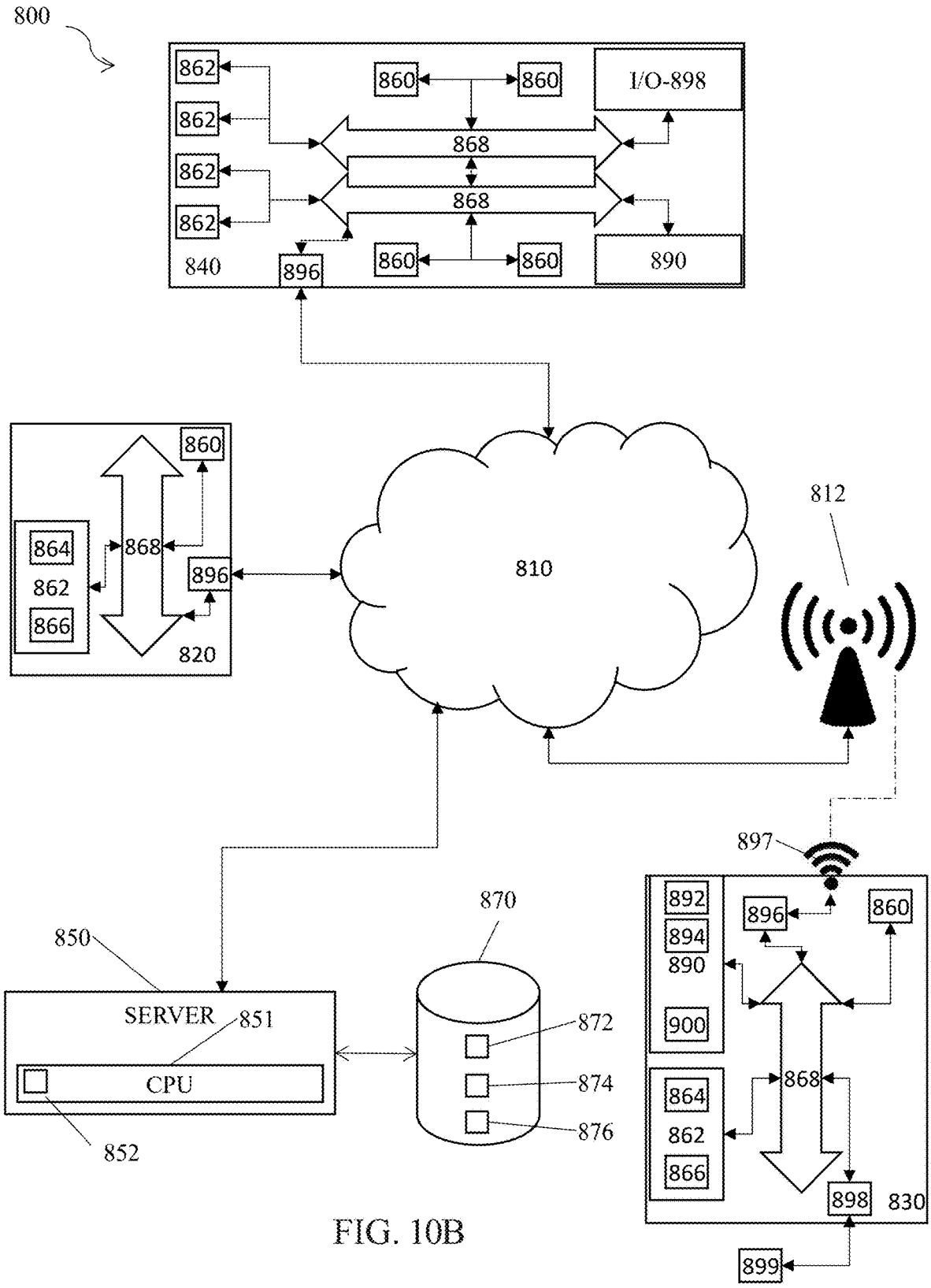
FIG. 10B is a schematic diagram of a system of the present invention.

FIG. 10B is a schematic diagram of an embodiment of the invention illustrating a computer system, generally described as 800, having a network 810, a plurality of computing devices 820, 830, 840, a server 850, and a database 870.

The server 850 is constructed, configured, and coupled to enable communication over a network 810 with a plurality of computing devices 820, 830, 840. The server 850 includes a processing unit 851 with an operating system 852. The operating system 852 enables the server 850 to communicate through network 810 with the remote, distributed user devices. Database 870 is operable to house an operating system 872, memory 874, and programs 876.

In one embodiment of the invention, the system 800 includes a network 810 for distributed communication via a wireless communication antenna 812 and processing by at least one mobile communication computing device 830. Alternatively, wireless and wired communication and connectivity between devices and components described herein include wireless network communication such as WI-FI, WORLDWIDE INTEROPERABILITY FOR MICROWAVE ACCESS (WIMAX), Radio Frequency (RF) communication including RF identification (RFID), NEAR FIELD COMMUNICATION (NFC), BLUETOOTH including BLUETOOTH LOW ENERGY (BLE), ZIGBEE, Infrared (IR) communication, cellular communication, satellite communication, Universal Serial Bus (USB), Ethernet communications, communication via fiber-optic cables, coaxial cables, twisted pair cables, and/or any other type of wireless or wired communication. In another embodiment of the invention, the system 800 is a virtualized computing system capable of executing any or all aspects of software and/or application components presented herein on the computing devices 820, 830, 840. In certain aspects, the computer system 800 is operable to be implemented using hardware or a combination of software and hardware, either in a dedicated computing device, or integrated into another entity, or distributed across multiple entities or computing devices.

By way of example, and not limitation, the computing devices 820, 830, 840 are intended to represent various forms of electronic devices including at least a processor and a memory, such as a server, blade server, mainframe, mobile phone, personal digital assistant (PDA), smartphone, desktop computer, netbook computer, tablet computer, workstation, laptop, and other similar computing devices. The components shown here, their connections and relationships, and their functions, are meant to be exemplary only, and are not meant to limit implementations of the invention described and/or claimed in the present application.

In one embodiment, the computing device 820 includes components such as a processor 860, a system memory 862 having a random access memory (RAM) 864 and a read-only memory (ROM) 866, and a system bus 868 that couples the memory 862 to the processor 860. In another embodiment, the computing device 830 is operable to additionally include components such as a storage device 890 for storing the operating system 892 and one or more application programs 894, a network interface unit 896, and/or an input/output controller 898. Each of the components is operable to be coupled to each other through at least one bus 868. The input/output controller 898 is operable to receive and process input from, or provide output to, a number of other devices 899, including, but not limited to, alphanumeric input devices, mice, electronic styluses, display units, touch screens, gaming controllers, joy sticks, touch pads, signal generation devices (e.g., speakers), augmented reality/virtual reality (AR/VR) devices (e.g., AR/VR headsets), or printers.

By way of example, and not limitation, the processor 860 is operable to be a general-purpose microprocessor (e.g., a central processing unit (CPU)), a graphics processing unit (GPU), a microcontroller, a Digital Signal Processor (DSP), an Application Specific Integrated Circuit (ASIC), a Field Programmable Gate Array (FPGA), a Programmable Logic Device (PLD), a controller, a state machine, gated or transistor logic, discrete hardware components, or any other suitable entity or combinations thereof that perform calculations, process instructions for execution, and/or other manipulations of information.

In another implementation, shown as 840 in FIG. 10B, multiple processors 860 and/or multiple buses 868 are operable to be used, as appropriate, along with multiple memories 862 of multiple types (e.g., a combination of a DSP and a microprocessor, a plurality of microprocessors, one or more microprocessors in conjunction with a DSP core).

Also, multiple computing devices are operable to be connected, with each device providing portions of the necessary operations (e.g., a server bank, a group of blade servers, or a multi-processor system). Alternatively, some steps or methods are operable to be performed by circuitry that is specific to a given function.

According to various embodiments, the computer system 800 is operable to operate in a networked environment using logical connections to local and/or remote computing devices 820, 830, 840 through a network 810. A computing device 830 is operable to connect to a network 810 through a network interface unit 896 connected to a bus 868. Computing devices are operable to communicate communication media through wired networks, direct-wired connections or wirelessly, such as acoustic, RF, or infrared, through an antenna 897 in communication with the network antenna 812 and the network interface unit 896, which are operable to include digital signal processing circuitry when necessary. The network interface unit 896 is operable to provide for communications under various modes or protocols.

In one or more exemplary aspects, the instructions are operable to be implemented in hardware, software, firmware, or any combinations thereof. A computer readable medium is operable to provide volatile or non-volatile storage for one or more sets of instructions, such as operating systems, data structures, program modules, applications, or other data embodying any one or more of the methodologies or functions described herein. The computer readable medium is operable to include the memory 862, the processor 860, and/or the storage media 890 and is operable be a single medium or multiple media (e.g., a centralized or distributed computer system) that store the one or more sets of instructions 900. Non-transitory computer readable media includes all computer readable media, with the sole exception being a transitory, propagating signal per se. The instructions 900 are further operable to be transmitted or received over the network 810 via the network interface unit 896 as communication media, which is operable to include a modulated data signal such as a carrier wave or other transport mechanism and includes any delivery media. The term "modulated data signal" means a signal that has one or more of its characteristics changed or set in a manner as to encode information in the signal.

Storage devices 890 and memory 862 include, but are not limited to, volatile and non-volatile media such as cache, RAM, ROM, EPROM, EEPROM, FLASH memory, or other solid state memory technology; discs (e.g., digital versatile discs (DVD), HD-DVD, BLU-RAY, compact disc (CD), or CD-ROM) or other optical storage; magnetic cassettes, magnetic tape, magnetic disk storage, floppy disks, or other magnetic storage devices; or any other medium that are able to be used to store the computer readable instructions and which are able to be accessed by the computer system 800.

In one embodiment, the computer system 800 is within a cloud-based network. In one embodiment, the server 850 is a designated physical server for distributed computing devices 820, 830, and 840. In one embodiment, the server 850 is a cloud-based server platform. In one embodiment, the cloud-based server platform hosts serverless functions for distributed computing devices 820, 830, and 840.

In another embodiment, the computer system 800 is within an edge computing network. The server 850 is an edge server, and the database 870 is an edge database. The edge server 850 and the edge database 870 are part of an edge computing platform. In one embodiment, the edge server 850 and the edge database 870 are designated to distributed computing devices 820, 830, and 840. In one embodiment, the edge server 850 and the edge database 870 are not designated for distributed computing devices 820, 830, and 840. The distributed computing devices 820, 830, and 840 connect to an edge server in the edge computing network based on proximity, availability, latency, bandwidth, and/or other factors.

It is also contemplated that the computer system 800 is operable to not include all of the components shown in FIG. 10B, is operable to include other components that are not explicitly shown in FIG. 10B, or is operable to utilize an architecture completely different than that shown in FIG. 10B. The various illustrative logical blocks, modules, elements, circuits, and algorithms described in connection with the embodiments disclosed herein are operable to be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans are able to implement the described functionality in varying ways for each particular application (e.g., arranged in a different order or partitioned in a different way), but such implementation decisions should not be interpreted as causing a departure from the scope of the present invention.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A golf swing and ball path visualization system, comprising:

at least one tag device affixed to a golf club operable to generate swing sensor data including position, velocity, and/or acceleration data for the golf club;

a launch monitor including a ball capture system operable to generate launch parameter data for a golf ball struck by the golf club;

wherein the launch parameter data includes a descent angle of the golf ball;

wherein the ball capture system includes radar transmitters and receivers, and/or photometric cameras; and at least one display device;

wherein the at least one tag device is configured to transmit the swing sensor data to a software application associated with the launch monitor, wherein the software application includes a tag device software development kit (SDK);

wherein the tag device SDK generates swing parameters based on the swing sensor data;

wherein the tag device SDK identifies one or more key swing milestones based on the swing sensor data and performs subsequent motion analysis to reconstruct a golf swing with the one or more key swing milestones as reference points;

wherein the launch parameter data and the swing parameters are transmitted to and stored in at least one database;

wherein the at least one display device displays a 2-D or 3-D reconstruction of the golf swing and a golf ball trajectory based on matched data points from the launch parameter data and the swing parameters;

wherein the at least one tag device includes at least one magnetometer; and wherein the at least one display device includes a graphical user interface (GUI) with a slider element, and wherein movement of the slider element causes the 2-D or 3-D reconstruction of the golf swing to move;

wherein the swing parameters include a shaft angle measurement of the golf club and hand speed; and wherein the at least one display device displays the shaft angle measurement of the golf club and the hand speed at a plurality of points in the golf swing alongside the 2-D or 3-D reconstruction of the golf swing through click selection of the 2-D or 3-D reconstruction of the golf swing.

2. The system of claim 1, wherein the at least one tag device further includes one or more of: an accelerometer, a gyroscope, and/or a piezo sensor.

3. The system of claim 1, wherein the at least one database includes a launch parameter database, configured to store the launch parameter data, and a separate tag database, configured to store the swing parameters.

4. The system of claim 1, wherein the at least one tag device, the launch monitor, and/or the at least one display device communicate via BLUETOOTH LOW ENERGY protocols.

5. The system of claim 1, wherein the golf swing and the golf ball trajectory are matched based on timestamp data included in the swing parameters for the golf swing and timestamp data included in the launch parameter data in the golf ball trajectory.

6. The system of claim 1, wherein the software application transmits the swing parameters to the at least one database via an application programming interface (API).

7. The system of claim 1, wherein the at least one tag device includes a plurality of tag devices, each associated with a unique ID and a specific golf club, and wherein the at least one display device indicates and shows the specific golf club used in the displayed golf swing.

8. The system of claim 1, wherein the launch monitor data is used to calibrate the at least one tag device.

9. The system of claim 1, wherein the at least one display device displays a club face angle measurement of the golf club alongside the 2-D or 3-D reconstruction of the golf swing through click selection of the 2-D or 3-D reconstruction of the golf swing.

10. A method for visualizing a golf swing and a golf ball trajectory, comprising:

at least one tag device affixed to a golf club generating swing sensor data including position, velocity, and/or acceleration data for the golf club;

a launch monitor, including a ball capture system, generating launch parameter data for a golf ball struck by the golf club;

wherein the launch parameter data includes a descent angle of the golf ball;

wherein the ball capture system includes radar transmitters and receivers, and/or photometric cameras;

the at least one tag device transmitting the swing sensor data to a software application associated with the launch monitor, wherein the software application includes a tag device software development kit (SDK);

the tag device SDK generating swing parameters based on the swing sensor data;

transmitting the launch parameter data and the swing parameters to at least one database;

the tag device SDK identifying one or more key swing milestones based on the swing sensor data and performing subsequent motion analysis to reconstruct a golf swing with the one or more key swing milestones as reference points; and at least one display device displaying a 2-D or 3-D reconstruction of the golf swing and a golf ball trajectory based on matched data points from the launch parameter data and the swing parameters;

wherein the at least one tag device includes at least one magnetometer;

wherein the at least one display device includes a graphical user interface (GUI) with a slider element, and wherein movement of the slider element causes the 2-D or 3-D reconstruction of the golf swing to move;

wherein the swing parameters include a shaft angle measurement and hand speed of the golf club; and wherein the at least one display device displays the shaft angle measurement of the golf club and the hand speed at a plurality of points in the golf swing alongside the 2-D or 3-D reconstruction of the golf swing through click selection of the 2-D or 3-D reconstruction of the golf swing.

11. The method of claim 10, wherein the at least one tag device further includes one or more of: an accelerometer, a gyroscope, and/or a piezo sensor.

12. The method of claim 10, wherein the at least one database includes a launch parameter database and a separate tag database, and further comprising the launch parameter database storing the launch parameter data, and the separate tag database storing the swing parameters.

13. The method of claim 10, further comprising the at least one tag device, the launch monitor, and/or the at least one display device communicating via BLUETOOTH LOW ENERGY protocols.

14. The method of claim 10, further comprising matching the golf swing and the golf ball trajectory based on timestamp data included in the swing parameters for the golf swing and timestamp data included in the launch parameter data in the golf ball trajectory.

15. The method of claim 10, further comprising the software application transmitting the swing parameters to the at least one database via an application programming interface (API).

16. The method of claim 10, wherein the at least one tag device includes a plurality of tag devices, each associated with a unique ID and a specific golf club, and further comprising the at least one display device indicating and showing the specific golf club used in the displayed golf swing.

17. The method of claim 10, wherein the launch monitor data is used to calibrate the at least one tag device.

18. A golf swing and ball path visualization system, comprising:

at least one tag device affixed to a golf club operable to generate swing sensor data including position, velocity, and/or acceleration data for the golf club;

a launch monitor including a ball capture system operable to generate launch parameter data for a golf ball struck by the golf club;

wherein the launch parameter data includes a descent angle of the golf ball;

wherein the ball capture system includes radar transmitters and receivers, and/or photometric cameras; and at least one display device;

wherein the at least one tag device is configured to transmit the swing sensor data to a software application associated with the launch monitor, wherein the software application includes a tag device software development kit (SDK);

wherein the tag device SDK generates swing parameters based on the swing sensor data;

wherein the launch parameter data are stored in a launch parameter database;

wherein the swing parameters are transmitted via an application programming interface (API) and stored in a tag database;

wherein the tag device SDK identifies one or more key swing milestones based on the swing sensor data and performs subsequent motion analysis to reconstruct a golf swing with the one or more key swing milestones as reference points;

wherein swing parameters corresponding to the golf swing and launch parameter data corresponding to a golf ball strike are matched based on timestamp data;

wherein the at least one display device displays a 2-D or 3-D reconstruction of the golf swing and the golf ball strike;

wherein the at least one tag device includes at least one magnetometer;

wherein the at least one display device includes a graphical user interface (GUI) with a slider element, wherein movement of the slider element causes the 2-D or 3-D reconstruction of the golf swing to move;

wherein the swing parameters include a shaft angle measurement of the golf club and hand speed; and wherein the at least one display device displays the shaft angle measurement of the golf club and the hand speed at a plurality of points in the golf swing alongside the 2-D or 3-D reconstruction of the golf swing through click selection of the 2-D or 3-D reconstruction of the golf swing.

19. The system of claim 18, wherein the at least one tag device further includes one or more of: an accelerometer, a gyroscope, and/or a piezo sensor.

20. The system of claim 18, further comprising the at least one tag device, the launch monitor, and/or the at least one display device communicating via BLUETOOTH LOW ENERGY protocols.

* * * * *